United States Patent [19]

Muramatsu et al.

[11] 4,299,514

[45] Nov. 10, 1981

[54] COLLAPSIBLE RUBBER DAM

[75] Inventors: Tateo Muramatsu; Mamoru Kurihara, both of Yokohama, Japan

[73] Assignee: Bridgestone Tire Co., Ltd., Tokyo, Japan

[21] Appl. No.: 73,333

[22] Filed: Sep. 7, 1979

[30] Foreign Application Priority Data

| | | | |
|---|---|---|---|
| Dec. 6, 1978 | [JP] | Japan | 53/166963[U] |
| Dec. 6, 1978 | [JP] | Japan | 53/166964[U] |
| Dec. 11, 1978 | [JP] | Japan | 53/169021[U] |
| Dec. 20, 1978 | [JP] | Japan | 53/175165[U] |
| Dec. 21, 1978 | [JP] | Japan | 53/174258[U] |
| Dec. 22, 1978 | [JP] | Japan | 53/177612[U] |
| Dec. 22, 1978 | [JP] | Japan | 53/160336 |
| Feb. 6, 1979 | [JP] | Japan | 54/14273[U] |
| Feb. 9, 1979 | [JP] | Japan | 54/15758[U] |
| Feb. 26, 1979 | [JP] | Japan | 54/22849[U] |
| Mar. 2, 1979 | [JP] | Japan | 54/25547[U] |
| Jun. 2, 1979 | [JP] | Japan | 54/68223 |

[51] Int. Cl.[3] ..... E02B 7/04

[52] U.S. Cl. ..... 405/115; 405/107

[58] Field of Search ..... 405/115, 91, 68, 107

[56] References Cited

U.S. PATENT DOCUMENTS

| | | | |
|---|---|---|---|
| 3,173,269 | 3/1965 | Imbertson | 405/115 X |
| 3,246,474 | 4/1966 | Mesnager | 405/115 |
| 3,355,851 | 12/1967 | Imbertson et al. | 405/115 |
| 3,494,132 | 2/1970 | Logan | 405/68 |
| 3,703,811 | 11/1972 | Smith | 405/68 |
| 3,786,638 | 1/1974 | Fish | 405/115 |
| 3,834,167 | 9/1974 | Tabor | 405/115 |
| 4,140,424 | 2/1979 | Bretherick et al. | 405/68 |

FOREIGN PATENT DOCUMENTS

| | | | |
|---|---|---|---|
| 1589071 | 3/1970 | France | 405/68 |

*Primary Examiner*—Dennis L. Taylor

*Attorney, Agent, or Firm*—Sughrue, Mion, Zinn, Macpeak and Seas

[57] ABSTRACT

A collapsible rubber dam is disclosed. The collapsible rubber dam comprises a flexible plate body composed of a rubbery elastomeric material and provided with at least one split part at a predetermined position in a thickness direction and along a lengthwise direction thereof. The flexible plate body is airtightly secured to riverbed and riverbank by means of fitting members to serve the split part as an inflatable chamber during the supply of a fluid.

10 Claims, 63 Drawing Figures

COLLAPSIBLE RUBBER DAM

This invention relates to an improvement in collapsible rubber dams which are used as an intake dam for irrigation water, a tide embankment against storm surge, a barrier for damming seawater near a mouth of a river, a dam provided on a bank for control of floods, and the like.

Heretofore, automatically turning iron barriers have been known as a water-level regulating barrier for taking irrigation water or damming seawater at the mouth of the river. However, such iron barriers are actuated by a hydraulic cylinder or other means, so that the operation for maintenance of the barrier is very difficult. Further it is impossible to set the barrier at weak foundations.

Recently, there developed and put into practice are water-level regulating dams each composed of a rubbery sheet material, or so-called collapsible rubber dams, which are operated by direct supply of a fluid such as air, water or the like. These are easy in their installation and maintenance. Such rubber dams D are usually constructed by shaping the rubbery sheet material into a closed bag on the working site as shown in FIGS. 1 and 2. In this case, however, rubbery sheet materials with a thicker gauge cannot be used in view of the operability difficulties, so that the rubber dam is susceptible to damage under the influence of driftwoods, rolling stones and the like. Moreover, when the rubber dam is collapsed by deflating the fluid therefrom as shown in FIG. 2, the downstream part shown by symbol a is always in a folded state, so that cracks or other defects are apt to be caused at that part and hence the durability is degraded.

It is, therefore, an object of the invention to improve the above mentioned drawbacks of the conventional rubber dam without losing the merits inherent to the rubber dam.

According to the invention, there is provided a collapsible rubber dam comprising a flexible plate body composed of a rubbery elastomeric material and provided with at least one split part at a predetermined position in a thickness direction and along a lengthwise direction thereof; said plate body being airtightly secured to riverbed and riverbank by means of fitting members so as to serve said split part as an inflatable chamber during the supply of a fluid.

In a preferred embodiment of the invention, the split part is a hollow split part. And also, the inflatable chamber is reinforced with a bias cut weave fabric.

In a second preferred embodiment of the invention, an auxiliary inflatable chamber having a diameter smaller than that of the inflatable chamber is provided in the inflatable chamber along the lengthwise direction thereof. Further, the auxiliary inflatable chamber is filled with a fluidizable material capable of solidifying at room temperature. Alternatively, at least one continuous groove is formed in the inner wall of the inflatable chamber.

In a third preferred embodiment of the invention, a rigid coupling member is watertightly interposed between both free end portions of at least one split part formed in the flexible plate body along the lengthwise direction thereof.

In a fourth preferred embodiment of the invention, at least one partition wall is unitedly disposed inside the inflatable chamber to divide the chamber into at least two chamber parts.

In a sixth preferred embodiment of the invention, at least a part of the outer surface of the flexible plate body is roughened along the lengthwise direction thereof.

The invention will now be described in detail with reference to the accompanying drawings, wherein.

Figure 16A:
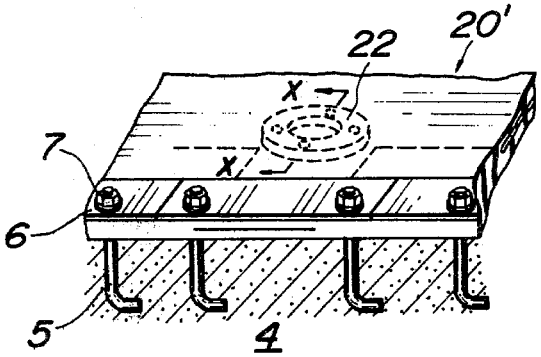
Figure 16B:
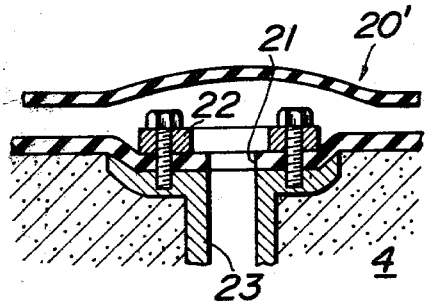

FIG. 16*a* is a perspective cut-away view of an embodiment of an inlet port for supplying a fluid, which is formed on the flexible plate body and connected to a pipe embedded in the riverbed;

FIG. 16*b* is a cross sectional view taken along the line X—X of FIG. 16*a*.

Figure 1:
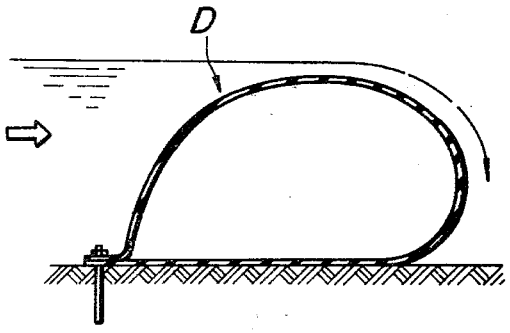
FIG. 1 PRIOR ART
FIG. 1 is a cross sectional view of a prior art rubber dam composed of rubbery sheet material in an inflated state as mentioned above.
Figure 2:
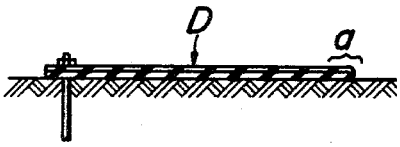
FIG. 2 PRIOR ART
FIG. 2 is a cross sectional view of the rubber dam of FIG. 1 in a deflated state as mentioned above.
Figure 9:
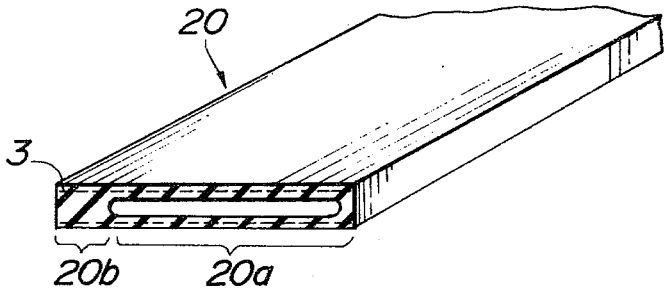
FIGS. 9, 11 and 13 are perspective cut-away views of various embodiments of the flexible plate body having a hollow split part according to the invention in the deflated state, respectively.
Figure 10:
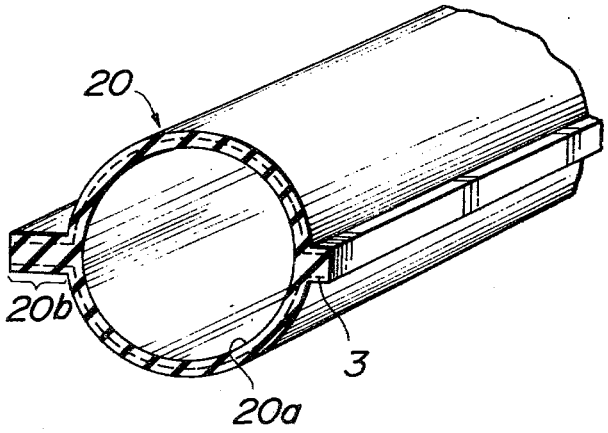
FIGS. 10, 12 and 14 are perspective cut-away views of the flexible plate bodies shown in FIGS. 9, 11 and 13 in the inflated state, respectively.
Figure 11:
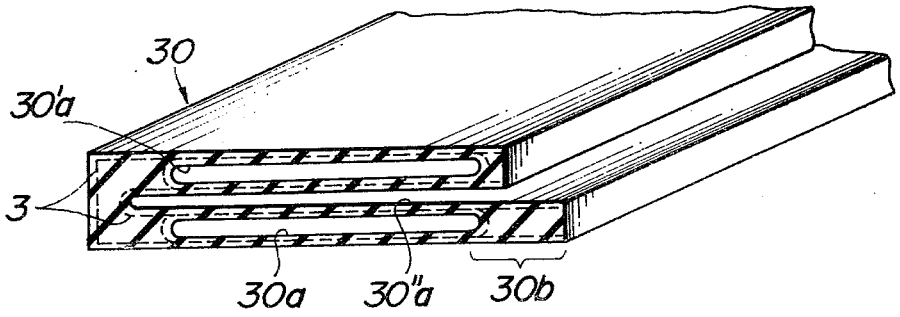
Figure 12:
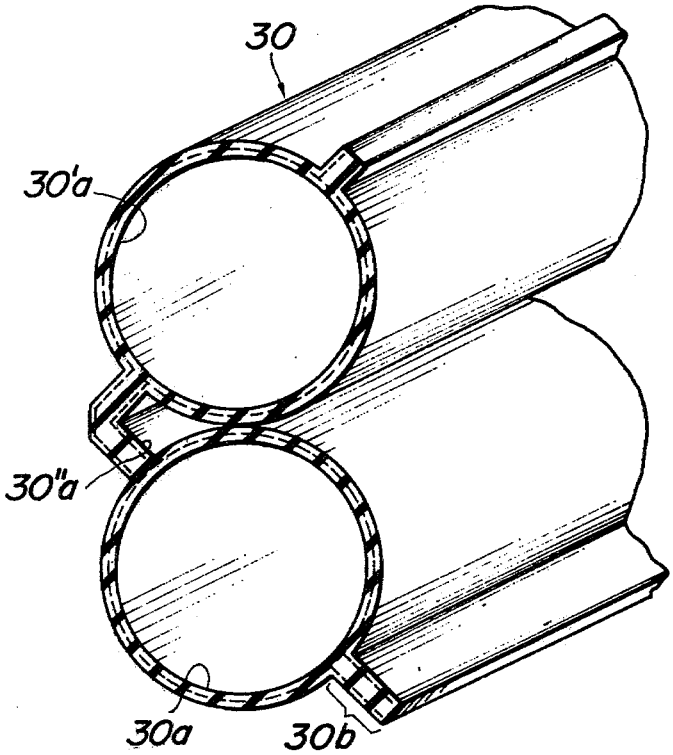
Figure 13:
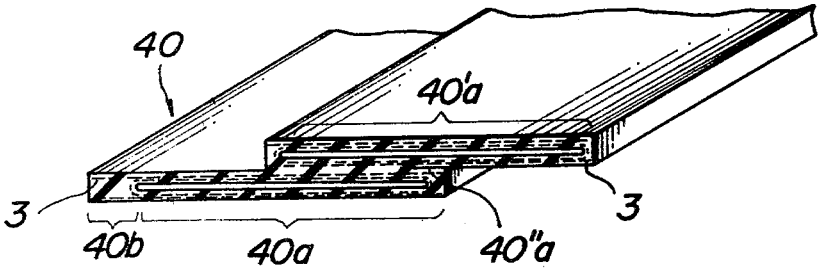
Figure 14:
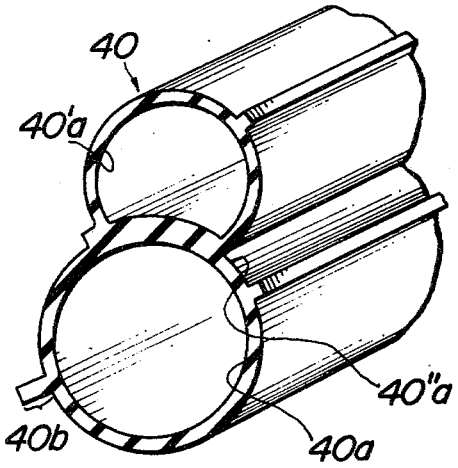
Figure 17:
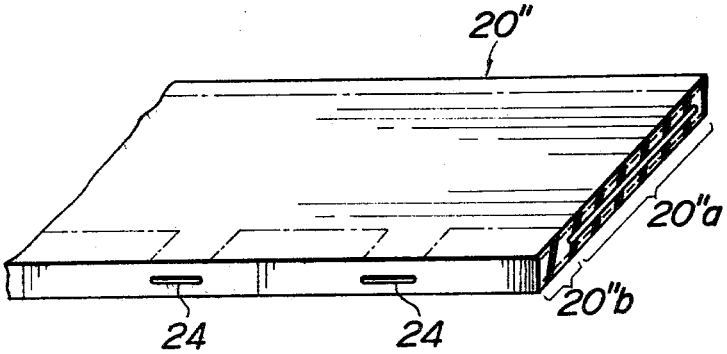
Figure 22:
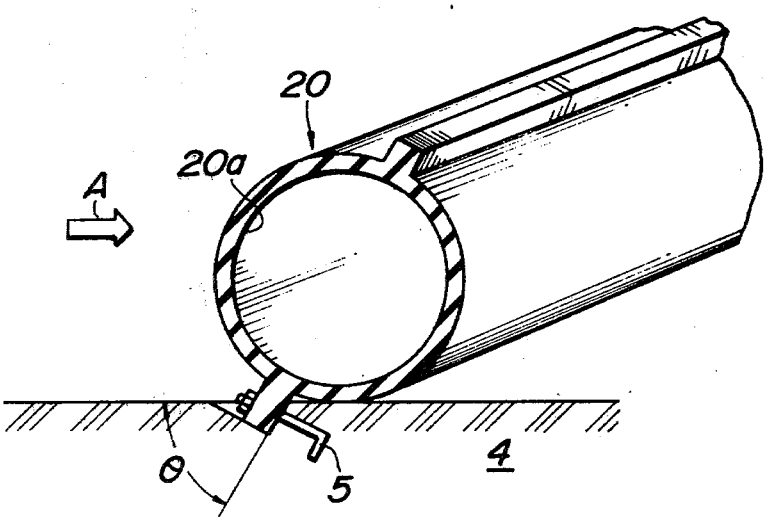
Figure 23:
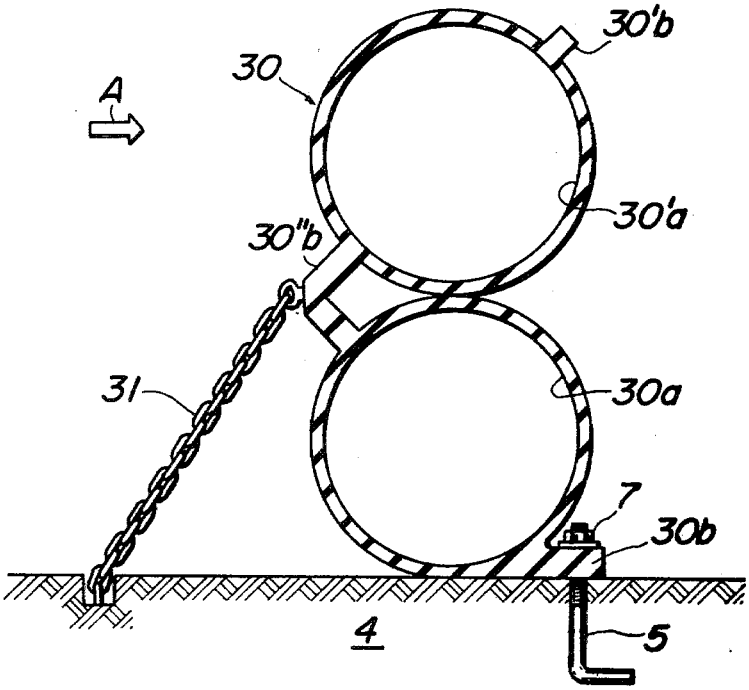
Figure 24:
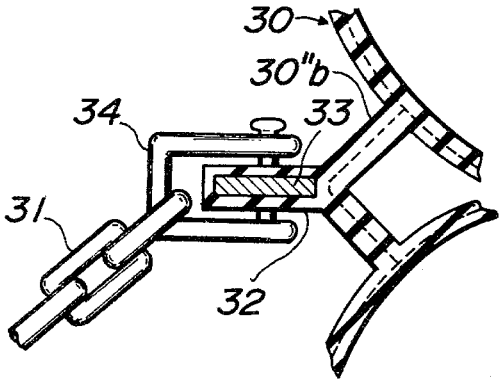
Figure 25:
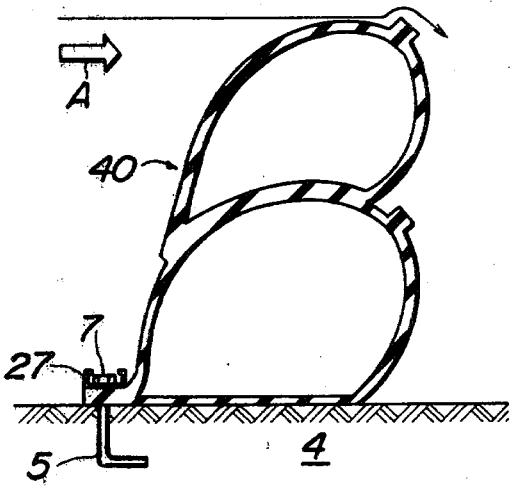
Figure 26:
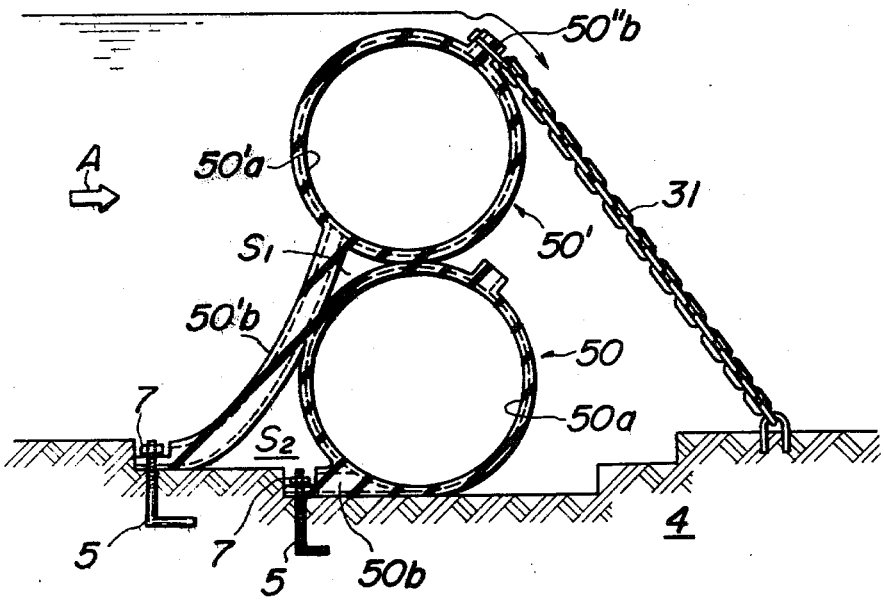
Figure 27:
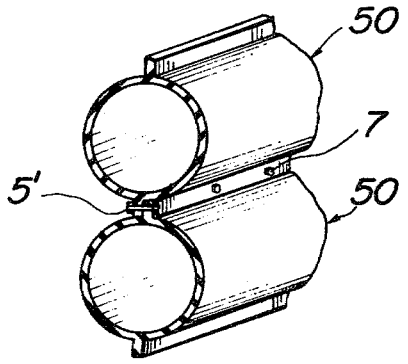
Figure 28:
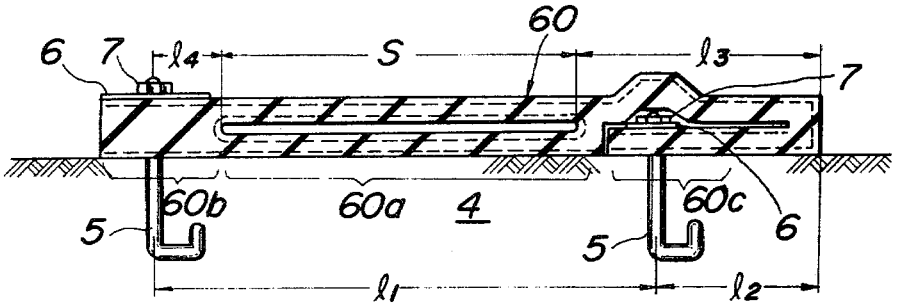
Figure 29A:
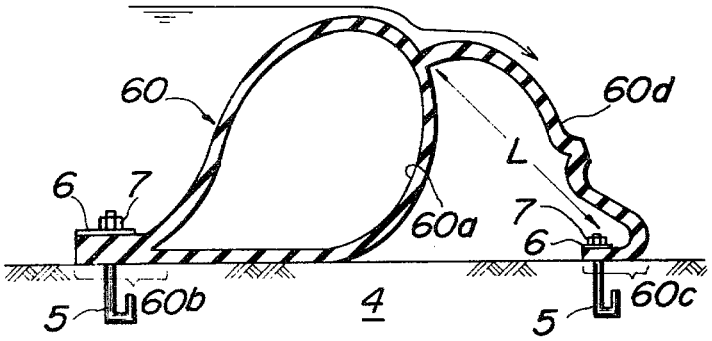
Figure 29B:
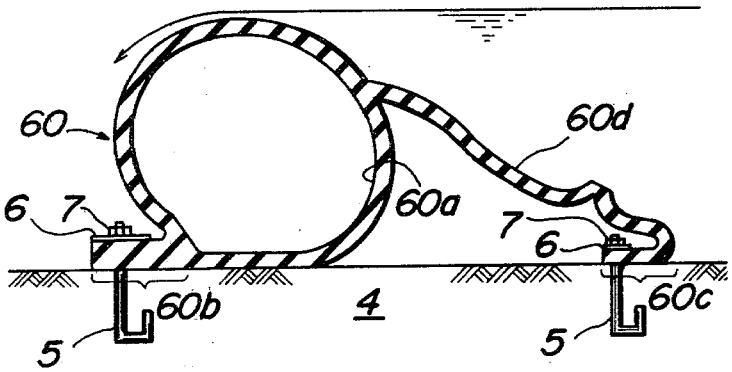
Figure 30:
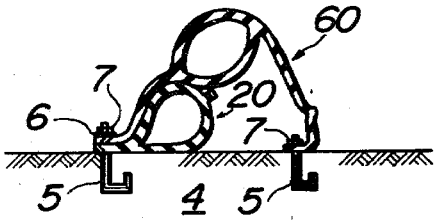
Figure 31:
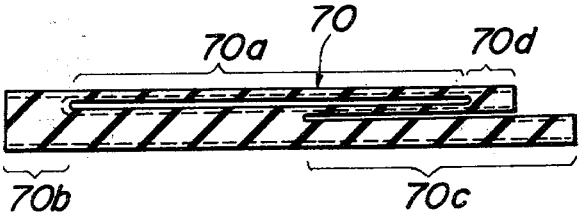
Figure 32A:
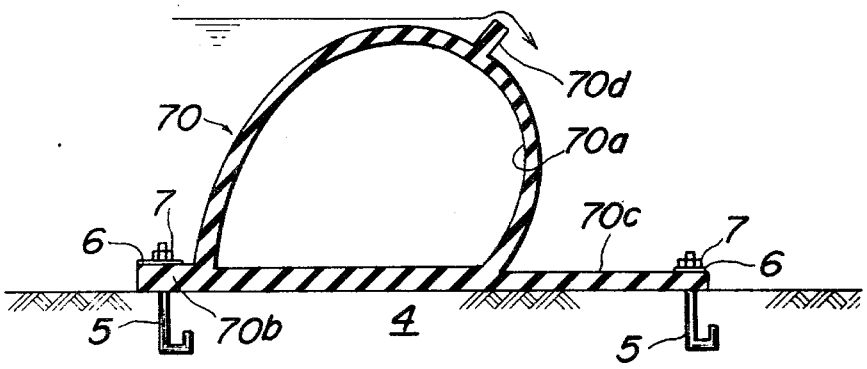
Figure 32B:
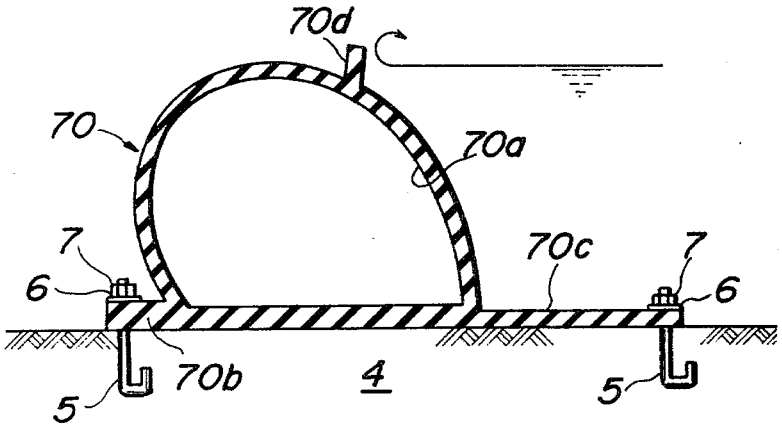
Figure 33:
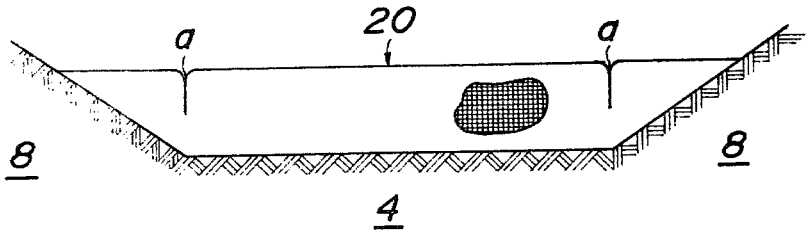
Figure 34:
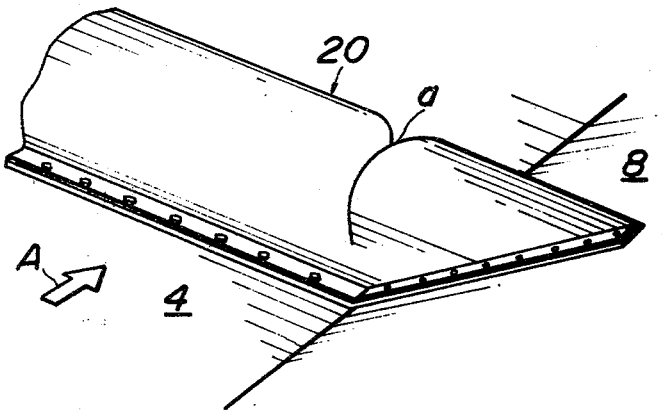
Figure 35:
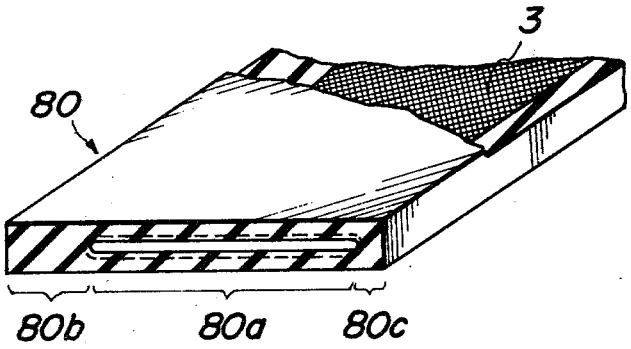
Figure 36:
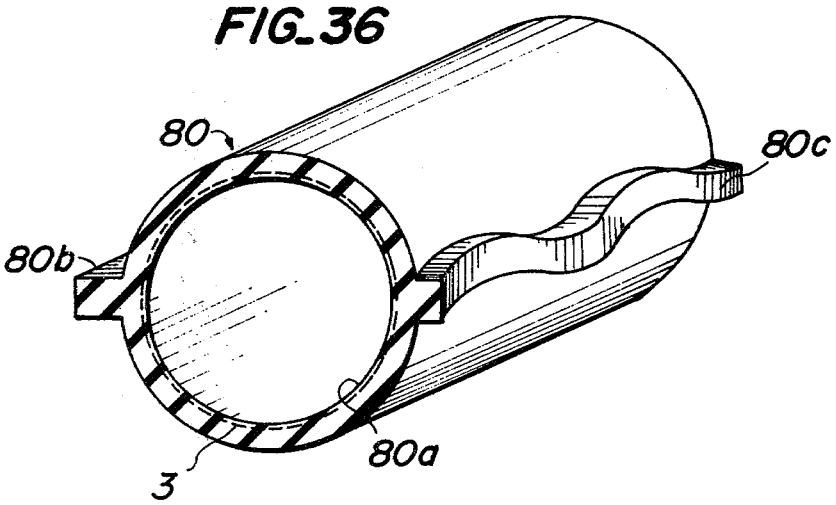
Figure 37:
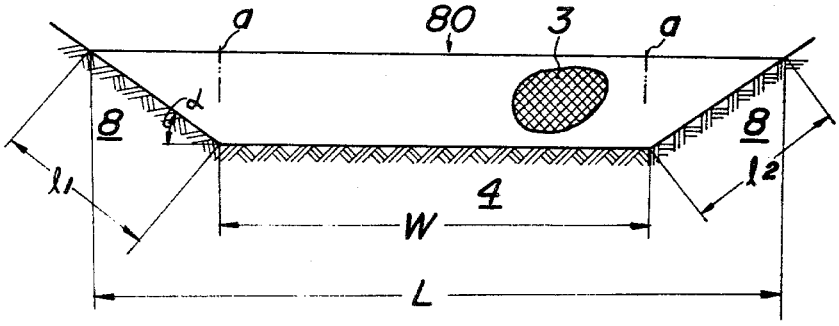
Figure 38:
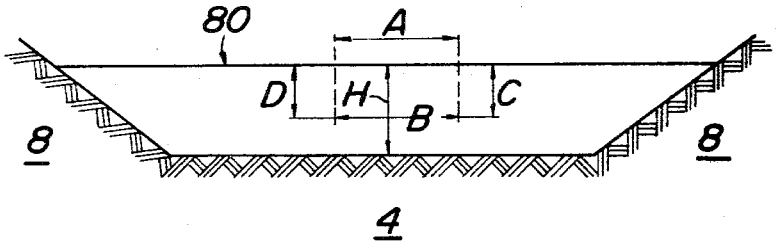
Figure 39:
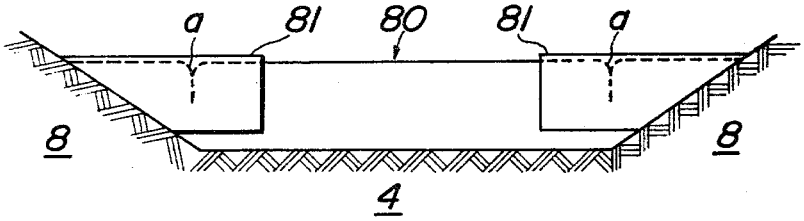
Figure 40:
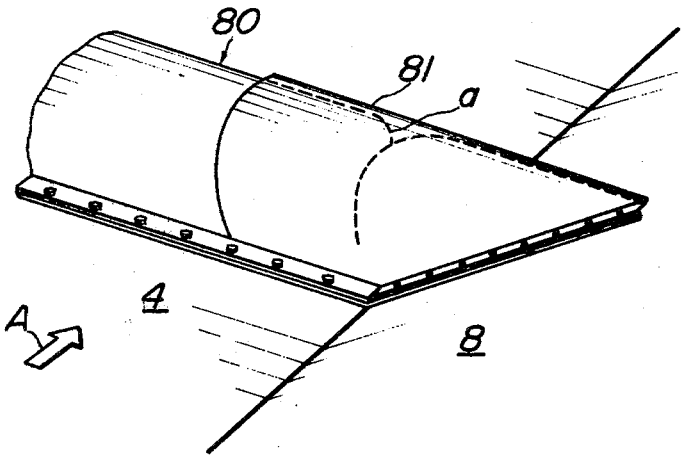
Figure 41A:
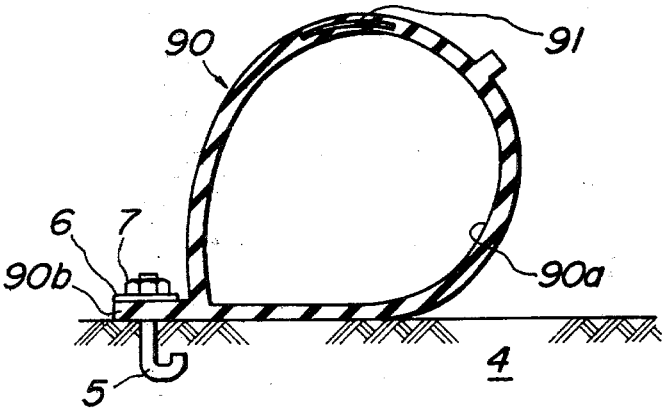
Figure 41B:
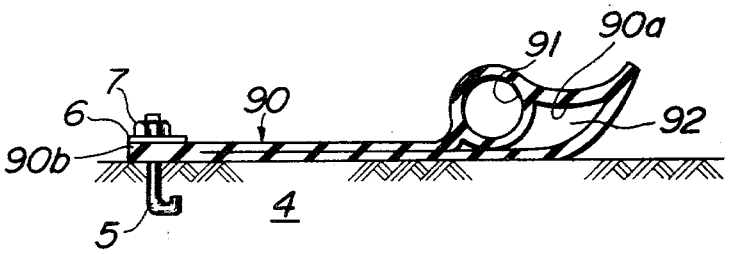
Figure 41C:
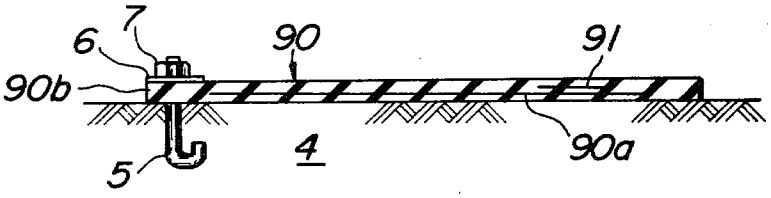
Figure 42:
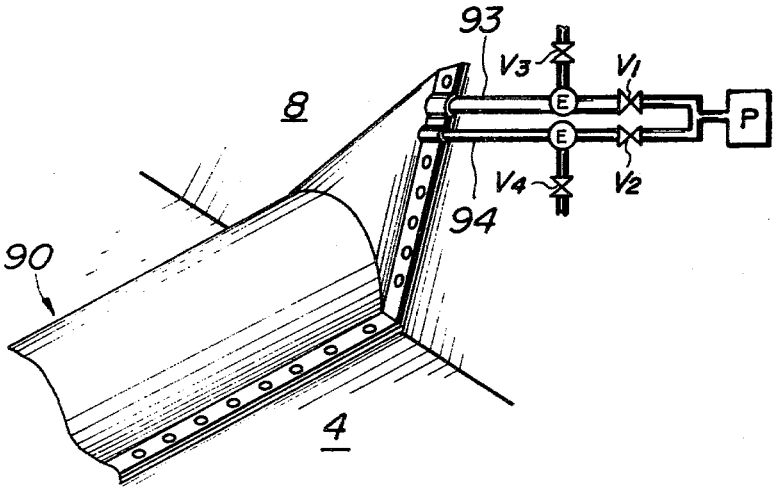
Figure 43A:
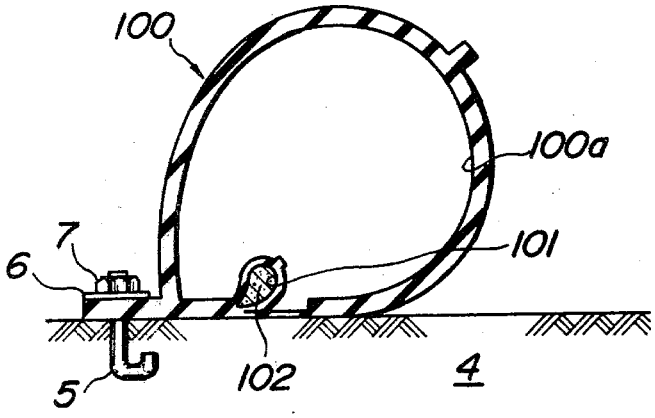
Figure 43B:
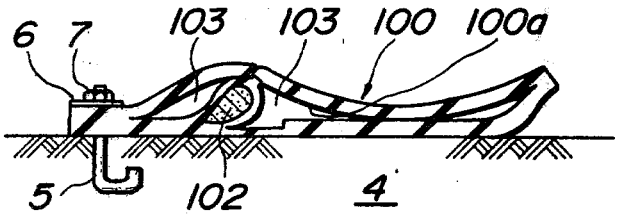
Figure 44A:
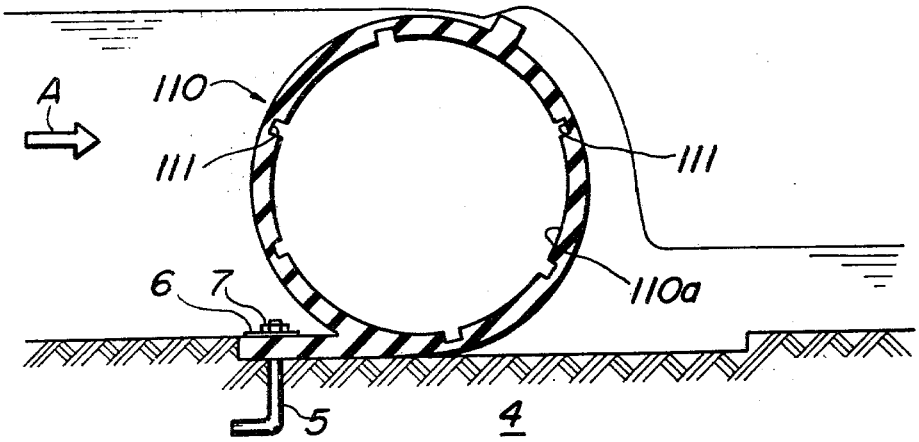
Figure 44B:
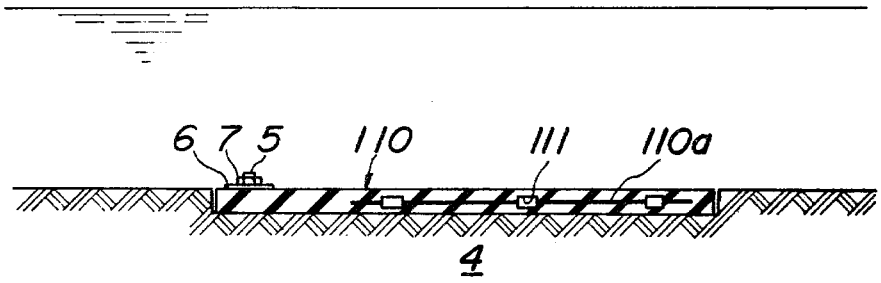
Figure 45:
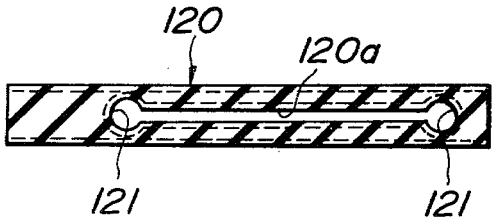
Figure 46:
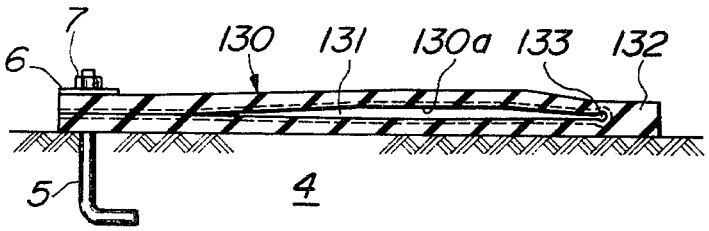
Figure 47A:
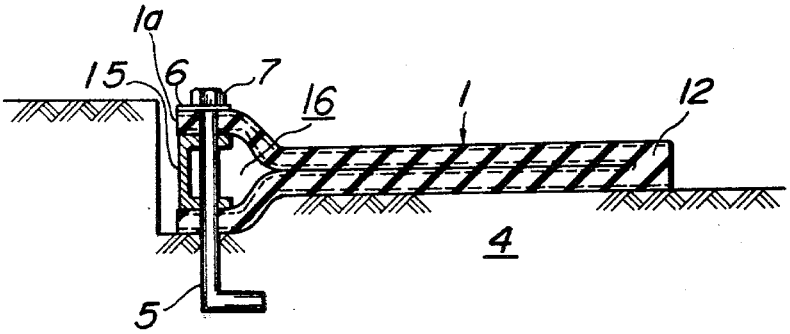
Figure 47B:
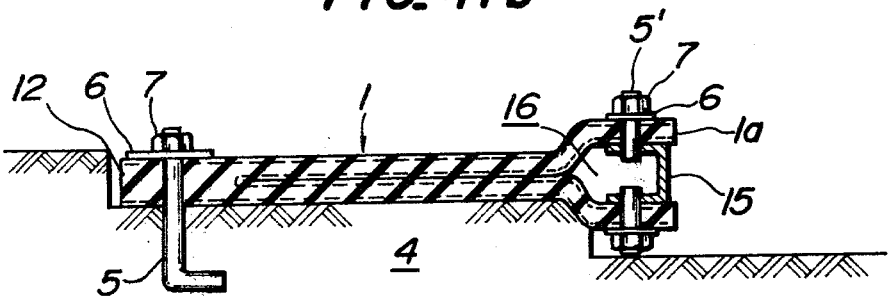
Figure 48:
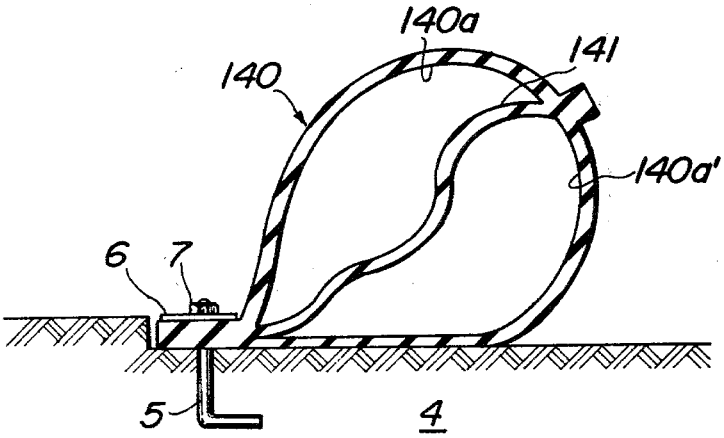
Figure 49:
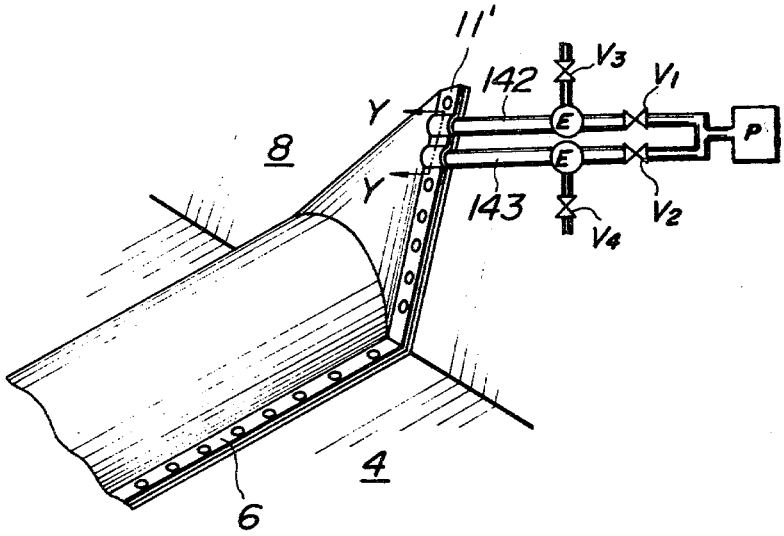
Figure 50:
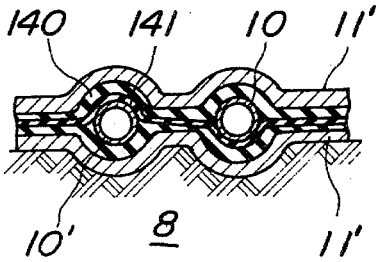
Figure 51:
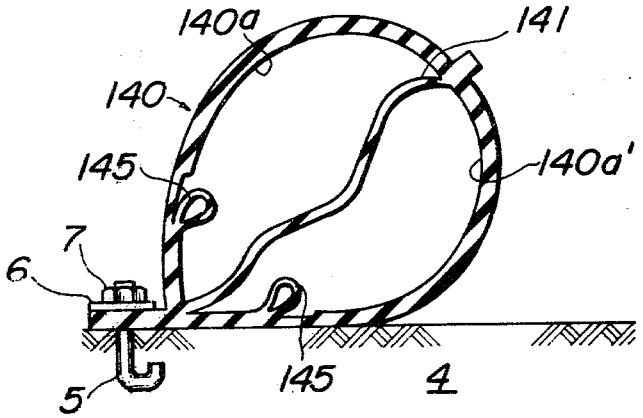
Figure 52:
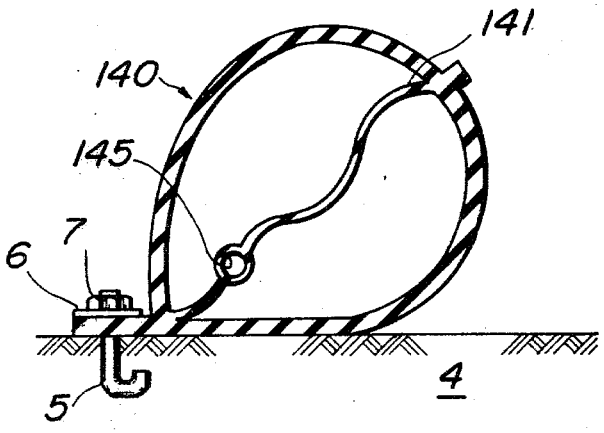
Figure 53:
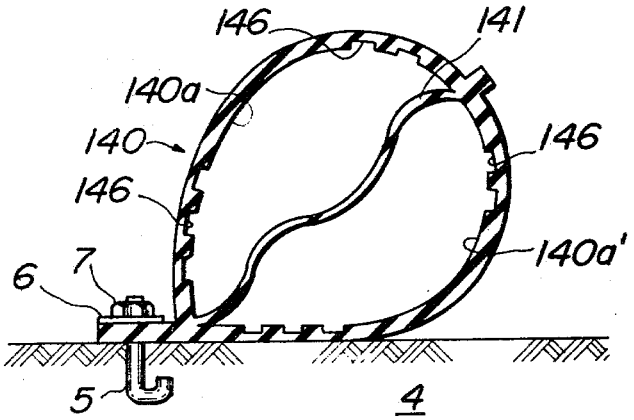
Figure 54A:
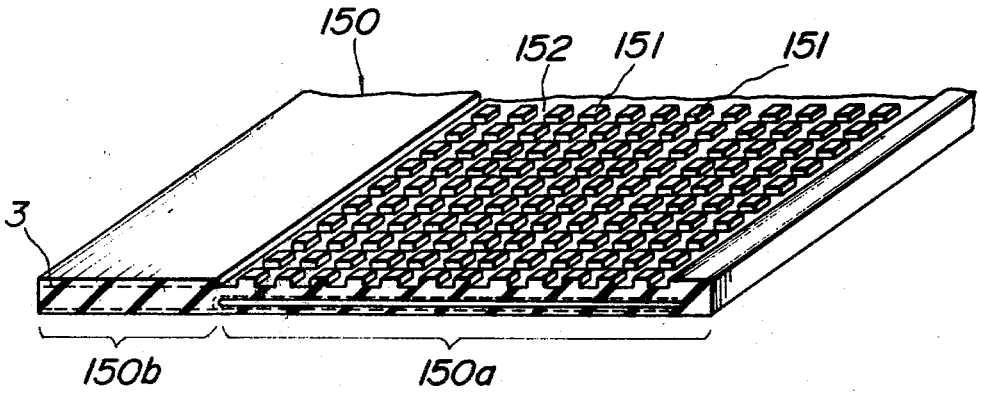
Figure 54B:
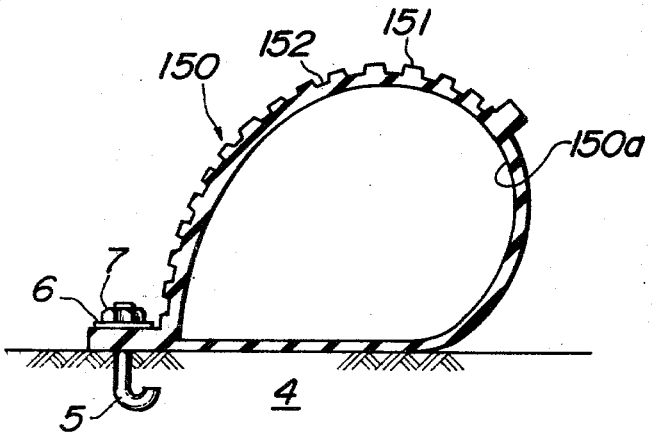

FIG. 17 is a perspective cut-away view of another embodiment of the flexible plate body provided at its plated fit portion with a plurality of inlet ports;

FIGS. 18 to 21 are partly cross sectional views of various embodiments for securing the flexible plate body to the riverbed, respectively;

FIG. 22 is a perspective view of an embodiment of the flexible plate body secured to the riverbed in an inflated state according to the invention;

FIGS. 23 and 25 are cross sectional views of the flexible plate bodies of FIGS. 11 and 13 secured to the riverbed in an inflated state, respectively;

FIG. 24 is a partly enlarged cross sectional view of another embodiment of the flexible plate body of FIG. 23;

FIG. 26 is a cross sectional view of an embodiment of the collapsible rubber dam composed of two flexible plate bodies placed one upon the other and secured to the riverbed in an inflated state;

FIG. 27 is a perspective view of an embodiment of the collapsible rubber dam composed of two flexible plate bodies connected with each other at their side ends in an inflated state;

FIG. 28 is a cross sectional view of an embodiment of the flexible plate body according to the invention secured at both side ends to the riverbed in the deflated state;

FIGS. 29*a* and 29*b* are cross sectional views of the flexible plate body of FIG. 28 in the inflated state during the use against forward and backward flows, respectively;

FIG. 30 is a cross sectional view of an embodiment of the collapsible rubber dam manufactured by combining the flexible plate body of FIG. 9 with the flexible plate body of FIG. 28;

FIG. 31 is a cross sectional view of an embodiment of the flexible plate body according to the invention;

FIGS. 32*a* and 32*b* are cross sectional views of the flexible plate body of FIG. 31 in the inflated state during the use against forward and backward flows, respectively;

FIGS. 33 and 34 are diagrammatically perspective views of the inflated state of the flexible plate body according to the invention secured to the riverbed and riverbank by the supply of the fluid, respectively;

FIG. 35 is a perspective view partly shown in section of an embodiment of the flexible plate body reinforced with a bias cut weave fabric according to the invention;

FIG. 36 is a perspective cut-away view illustrating the inflated state of the flexible plate body of FIG. 35;

FIG. 37 is a diagrammatical view illustrating the inflated state of the flexible plate body of FIG. 35 secured to the riverbed and riverbank by the supply of the fluid viewing from the downstream side;

FIG. 38 is a diagrammatical view illustrating an embodiment for measuring the contraction degree of the flexible plate body reinforced with the bias cut weave fabric according to the invention;

FIGS. 39 and 40 are diagrammatical and perspective views of an embodiment of the flexible plate body secured to the riverbed and riverbank and covered at both end portions near the riverbank with a flexible sheet, respectively;

FIGS. 41*a*–41*c* are cross sectional views of an embodiment of the flexible plate body having a main inflatable chamber and an auxiliary inflatable chamber according to the invention in the inflated and deflated states, respectively;

FIG. 42 is a perspective view of an embodiment of a piping system for supplying or discharging a fluid into or from the flexible plate body of FIG. 41;

FIGS. 43*a* and 43*b* are cross sectional views of an embodiment of the flexible plate body having a main inflatable chamber and an auxiliary inflatable chamber filled with a fluidizable material in the inflated and deflated states according to the invention, respectively;

FIGS. 44*a* and 44*b* are cross sectional views of an embodiment of the flexible plate body having a hollow split part provided with a plurality of grooves according to the invention in the inflated and deflated states, respectively;

FIG. 45 is a cross sectional view of another embodiment of the flexible plate body according to the invention;

FIG. 46 is a cross sectional view of an embodiment of the flexible plate body having an opened split part and secured to the riverbed according to the invention;

FIGS. 47*a* and 47*b* are cross sectional views of modified embodiments of the flexible plate body having an opened split end of FIG. 1 secured to the riverbed, respectively;

FIG. 48 is a cross sectional view of an embodiment of the flexible plate body having a partition wall therein in the inflated state according to the invention;

FIG. 49 is a perspective cut-away view of an embodiment of the piping system for the flexible plate body of FIG. 48;

FIG. 50 is a cross sectional view taken along the line Y—Y of FIG. 49;

FIGS. 51–53 are cross sectional views of modified embodiments of the flexible plate body having the partition wall therein in the inflated state, respectively; and FIGS. 54*a* and 54*b* are perspective view and cross sectional view of an embodiment of the flexible plate body having at its outer surface a great number of protrusions and depressions according to the invention in the deflated and inflated states, respectively.

Like parts are designated by like numerals and like symbols throughout the different figures of the drawing.

Figure 3:
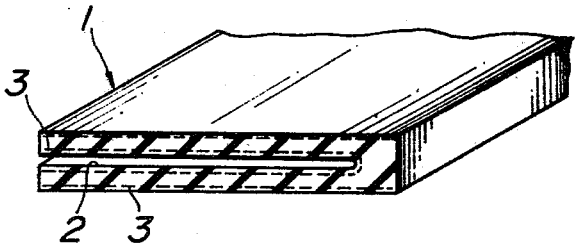
FIG. 3 is a perspective cut-away view of an embodiment of the flexible plate body having an opened split part according to the invention.

Referring to FIG. 3, numeral 1 represents a flexible plate body composed of a rubbery elastomeric material and having an open split part 2, which is formed at a predetermined position in a thickness direction of the body and along a lengthwise direction thereof. The plate body may be reinforced with a canvas 3, if necessary.

The manufacture of the flexible plate body 1 is carried out as follows. For instance, two crude rubber sheets are piled one upon the other and placed on a heat surface plate of a molding press. Then, an antitack member is interposed between the crude rubber sheets along the lengthwise direction thereof to leave only end portions of the sheets in contact sheet. Thereafter, the crude rubber sheet assembly is pressed at a vulcanizing temperature of the crude rubber sheet to obtain the flexible plate body 1 having the opened split part 2 therein. In this case, a desirable reinforcing layer can be obtained by properly embedding a canvas or bias cut weave fabric in the crude rubber sheet.

The thus obtained plate bodies 1 are well adaptable as a collapsible rubber dam to rivers, streams, channels and the like, which have various different widths, because they can be manufactured with a desired length. Further, the gauge of the plate body can freely be selected because the plate body is manufactured by the press molding of the rubber sheets.

The flexible plate body 1 is secured to riverbed and riverbank as follows with reference to FIGS. 4 and 5.

First, the open end portion of the flexible plate body 1 is positioned toward an upstream side of a river (in this case, the direction of stream is shown by an arrow A). Then, holes (not shown) pierced in the opened end portion receive respective anchor bolts 5 previously embedded in a riverbed 4. Thereafter, the opened end portion of the flexible plate body 1 is airtightly secured to the riverbed 4 through an elongated and perforated keep member 6 by means of nuts 7 as shown in FIG. 4.

Figure 5:
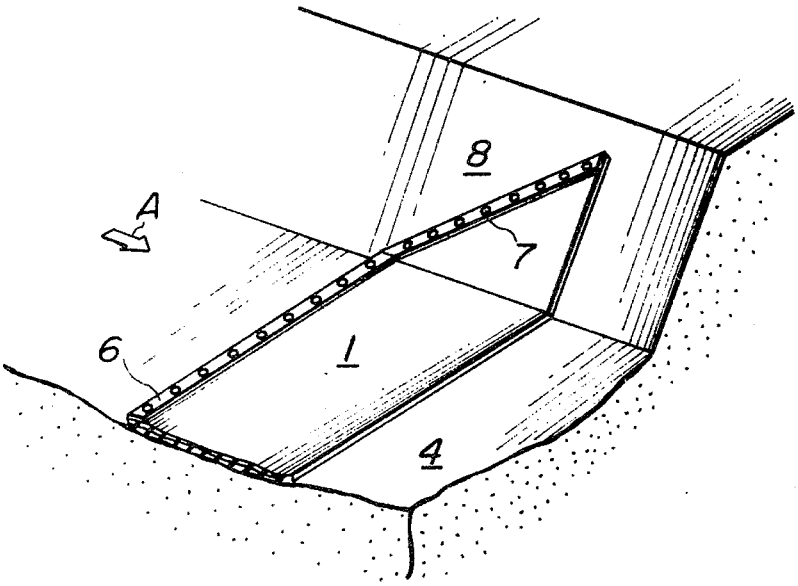

On the other hand, the opened end portion of the flexible plate body 1 is airtightly secured to a riverbank 8 by using the anchor bolts 5, the keep member 6 and the nuts 7 as shown in FIG. 5. The opened end portion is obliquely cut at a given angle toward a downstream side of the river.

Figure 6:
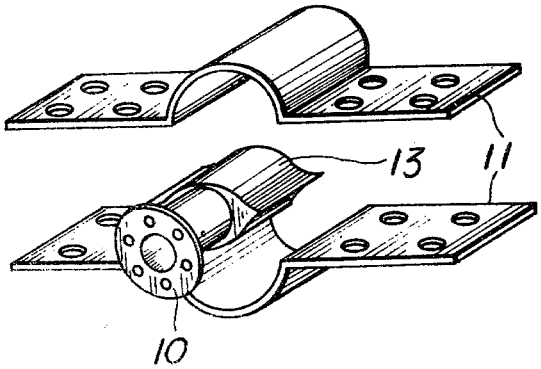
FIG. 6 is a developed perspective view of an embodiment of the inlet port for supplying a fluid to an inflatable chamber of the flexible plate body according to the invention.

After secured to the riverbed and riverbank, an inlet port for supplying a fluid to the split part 2 or a main inflatable chamber 9 is disposed in the flexible plate body 1 at a proper position. For instance, such an inlet port is constructed with a flanged nipple 10 and a pair of keep members 11 each having a semi-circular curved portion as shown in FIG. 6. In this case, the flanged nipple 10 is inserted at a proper position into the main inflatable chamber and then airtightly fixed at both sides thereof with the keep members 11 by bolt and nut. In order to more ensure the airtightness, the flanged nipple 10 may be provided at its periphery with a flexible packing 13 which is symmetrical in configuration with respect to the center axis of the nipple and is gradually tapered from the up and down sides toward the left and right sides in a direction perpendicular to the center axis of the nipple as shown in FIG. 6. Moreover, the position of the inlet port to be arranged in the flexible plate body is preferably an end portion of the body fixed to the riverbank.

Figure 7:
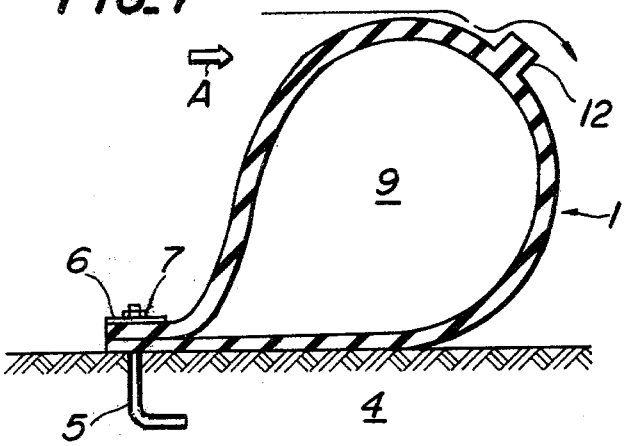
FIG. 7 is a cross sectional view illustrating the inflated state of the flexible plate body of FIG. 4 as a collapsible rubber dam.

FIG. 7 shows an inflated state of the flexible plate body 1 by supplying a fluid such as air, water or the like to the split part 2 constituting a main inflatable chamber 9 to form a rubber dam. In this case, the rubber dam is hardly subjected to damages by driftwoods and the like owing to the thicker gauge of the body constituting the rubber dam. Further, a joint portion 12 of the plate body acts as a throat, so that vibration of the rubber dam and hence fatigue phenomenon accompanied therewith are not caused. As a result, the rubber dam develops a stable damming effect. On the other hand, the flexible plate body becomes flat about the joint portion 12 in the deflated state as shown in FIG. 4, so that the rubber dam body 1 is flatly positioned on the riverbed 4 without causing specific stress. Therefore, the rubber dam body 1 does not exhibit the cracking phenomenon resulted from the generation of stress in the conventional rubber dam composed of rubbery sheet material as previously mentioned. Moreover, the damage by rolling stones and the like are prevented in the deflated state because the gauge of the rubber dam body is thicker.

Figure 4:
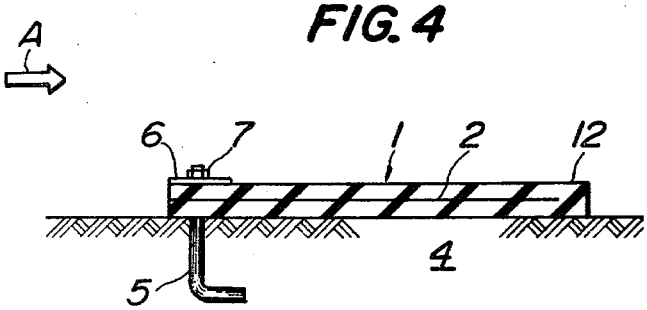
FIGS. 4 and 5 are cross sectional view and perspective view of an embodiment for securing the flexible plate body of FIG. 3 to riverbed and riverbank, respectively.
Figure 8:
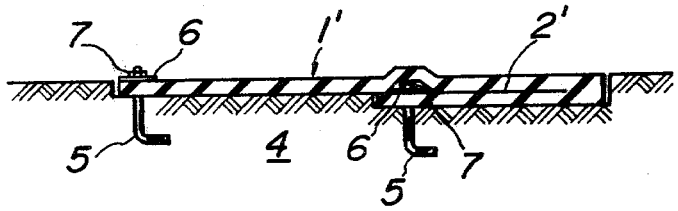
FIG. 8 is a cross sectional view of another embodiment of the flexible plate body according to the invention secured to the riverbed in the deflated state.

In FIG. 8 is shown another embodiment that the upper free end of the flexible plate body 1' with the split part 2' is projected considerably over the lower free end thereof and both end portions are separately secured to the riverbed 4 in the same manner as shown in FIGS. 4 and 5.

The invention will now be described below with reference to the case that at least one split part formed in the flexible plate body forms a hollow part by the closing between the opened free ends thereof.

In FIGS. 9, 11 and 13, numerals 20, 30 and 40 represent flexible plate bodies each composed of rubbery elastomeric material and reinforced with the canvas 3 or the like, respectively. The flexible plate body 20 of FIG. 9 has a hollow split part 20*a* constituting an inflatable chamber and a solid flange portion 20*b* extending along the lengthwise direction of the body. On the other hand, each flexible plate bodies 30 or 40 of FIGS. 11 and 13 has two hollow split parts 30*a* and 30'*a* or 40*a* and 40'*a*, one opened split part 30''*a* or 40''*a* and a solid flange portion 30*b* or 40*b* different from the case of FIG. 9.

These flexible plate bodies 20, 30 and 40 can be manufactured by the integrant press molding in the same manner as described on the case of FIG. 3. Preferably, a bias cut weave fabric is used as a carcass reinforcement.

Figure 15:
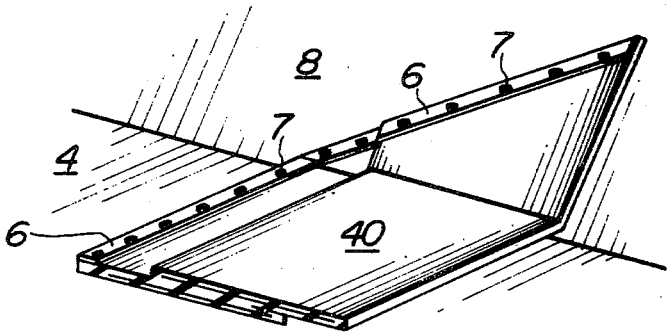
FIG. 15 is a perspective cut-away view of an embodiment for securing the flexible plate body of FIG. 13 to the riverbed and riverbank in the deflated state.

The airtightness of these flexible plate bodies is attained as follows. For instance, each opened end portion of the flexible plate body 20 may be previously adhered by vulcanization during the manufacture of the body. However, rivers and the like adopting the flexible plate body as a collapsible rubber dam have usually various different widths, so that it is desirable to cut the flexible plate body into a length corresponding to the river width. In this case, each cut end portion of the flexible plate body after the vulcanization molding may be sandwiched between a pair of keep members and fastened by bolts and nuts, respectively, or the cut end portion of the flexible plate body 40 may directly be secured to the riverbank 8 through the keep member 6 by bolts and nuts as shown in FIG. 15. In this way, the flexible plate body with an optional length corresponding to a width of a river to be settled can be constructed simply and conveniently as a collapsible rubber dam having a higher airtightness, so that the operation efficiency is improved as compared with the case of shaping the rubbery sheet material into a closed bag on the working site. The embodiment shown in FIG. 15 is the case of airtightly closing the cut end portion of the flexible plate body 40 shown in FIG. 13, but the similar result is also obtained in the embodiments of FIGS. 9 and 11.

In order to supply a fluid such as air, water or the like to the inflatable chamber of the flexible plate body, the flanged nipple 10 and keep members 11 as shown in FIG. 6 are arranged at a given position of the flexible plate body to form an inlet port for the inflatable chamber. Alternatively, as shown in FIGS. 16*a* and 16*b*, a pipe 23 previously embedded in the riverbed 4 directly communicates with an opening 21 formed on the side of the flexible plate body 20' facing to the riverbed in place through a flange 22. As shown in FIG. 17, a plurality of inlet ports 24 for the supply of the fluid may be formed in the solid flange portion 20''*b* of the flexible plate body 20'' at proper intervals along the lengthwise direction thereof.

Next, the securing of the flexible plate body to the riverbed will be described below with reference to FIGS. 18–21. The embodiments of FIGS. 18–21 merely show the securing manner of the flexible plate body 20 shown in FIG. 9 to the riverbed 4.

Figure 18:
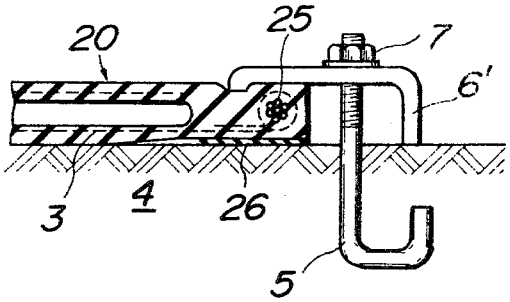

In the embodiment of FIG. 18, the flexible plate body 20 reinforced with bead wires or steel cords 25, which are embedded in the plate fit portion 20*b*, is secured to the riverbed 4 by engaging the flange portion 20*b* of the flexible plate body 20 with a keep metal member 6' along the lengthwise direction to suppress the movement of the bead wire 13 inside the flange portion 20*b* and fastening it with anchor bolts 5 previously embedded in the riverbed 4 and nuts 7. In this case, the airtightness in the secured portion of the flexible plate body may be improved by interposing a sealant 26 or the like between the flange portion 20*b* and the riverbed 4.

Figure 19:
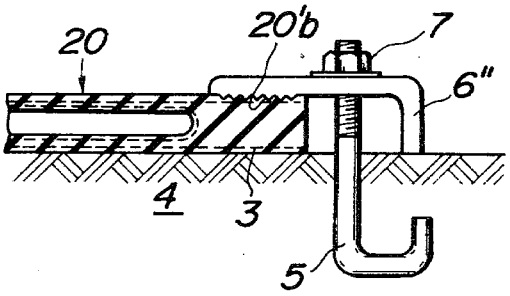

In the embodiment of FIG. 19, the flexible plate body 20 has a plurality of flutes 20'*b* formed on the outer surface of the flange portion 20*b* along the lengthwise direction thereof. The flange portion 20*b* of the flexible plate body 20 is secured to the riverbed 4 through anchor bolts 5 and nuts 7 by using a keep metal member 6'' with a plurality of projections matching the flutes 20'*b*. The formation of flutes 20'*b* makes it possible to increase a friction coefficient at the secured portion of the flexible plate body, so that a strong securing of the flexible plate body sufficiently withstanding to water pressure can be expected.

Figure 20:
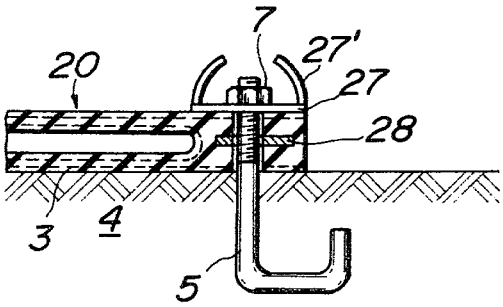

In the embodiment of FIG. 20, the flexible plate body 20 is secured to the riverbed 4 through washers 27 with anchor bolts 5 and nuts 7 without using the special keep metal member 6' or 6''. In this embodiment, a spring steel washer 28 is embedded as a reinforcement in the plated fit portion 20*b* along the lengthwise direction thereof. Further, a curved protective metal member 27' is welded on the surface of the washer 27 to protect the nut 7.

Figure 21:
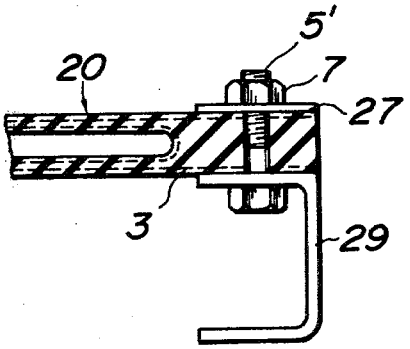

The embodiment of FIG. 21 is different from the embodiments of FIGS. 18–20 wherein the flexible plate body is secured to the riverbed with anchor bolts 5 previously embedded therein. That is, shape steels 21 are previously fixed at proper intervals to the flange portion 20*b* of the flexible plate body 20 reinforced with canvas, spring steel or the like through washers 27, bolts 5' and nuts 7. In order to secure the flexible plate body provided with shape steels to the riverbed, the body is temporarily located on the riverbed and thereafter, the shape steels are properly embedded in the riverbed in the usual manner. Therefore, this embodiment is excellent in workability.

Although the flexible plate body 20, particularly the portion 20*b* thereof is reinforced with the bead wire, steel cord, canvas, spring steel or the like as shown in FIGS. 18–21, it is desirable to make the flexible plate body flexible as a whole even in the presence of such reinforcing layer, because it is frequently required to transport the flexible plate body having a length corresponding to the width of the river, in a wound state to the working site.

The flexible plate body is secured to the riverbed as described above. Similarly, both end portions of the flexible plate body may be secured to the riverbanks with a proper means without damaging the airtightness, respectively.

According to the invention, the flexible plate body having an excellent airtightness and serving just as a collapsible rubber dam is secured to the riverbed and riverbank different from the prior art of shaping the rubbery sheet material into an airtight bag on the working site, so that the securing operation can be hastened independently of the airtightening of the dam body or the inflatable chamber. Further, only the securing of one side (i.e. plated fit portion) of the flexible plate body is sufficient, so that not only the workability is improved as compared with the securing of the sheet material, but also the reliability of airtightness is very high.

FIG. 22 shows an inflated state of the flexible plate body 20 as shown in FIG. 9, which is secured to the riverbed 4 at an angle $\theta$ (the value of $\theta$ is 0°–90°, but is not critical) with anchor bolts 5 and the like and forms a collapsible rubber dam by supplying a fluid to the inflatable chamber 20*a*.

The fluid to be supplied to the inflatable chamber 20*a* is usually air, water or the like. However, the collapsible rubber dam is often located at a place having no power source. In the latter case, it is favorable to utilize an exhaust gas generated from an automobile as the fluid. Since the pressure of the exhaust gas is usually about 0.7 kg/cm$^2$ gauge, it is possible to inflate the collapsible rubber dam to a height of about 7 m by supplying the exhaust gas.

FIGS. 23 and 25 show inflated states of the flexible plate bodies having two inflatable chambers as shown in FIGS. 11 and 13 after secured to the riverbed, respectively.

In the embodiment of FIG. 23, the solid flange portion 30*b* of the flexible plate body 30 is secured to the riverbed 4 with anchor bolts 5, nuts 7 and the like to direct a connection part 30''*b* between the inflatable chambers 30*a* and 30'*a* to the upstream side of the river, while the connection part 30''*b* is anchored to the riverbed 4 by means of claims 31 or the like, whereby the stability of the flexible plate body in the inflated state is considerably improved. In the anchoring of the connection part 30''*b* to the riverbed 4, an iron plate 33 or the like is embedded in a projection 32 of the connection part 30''*b* and extended along the lengthwise direction thereof. Then, shackles 34 are arranged in the projection 32 at given positions toward the lengthwise direction, to which are connected to free ends of respective chains 31 as shown in FIG. 24. The provision of the iron plate 33 may increase the rigidity of the connection part, maintain the height of the rubber dam constant, and reduce the number of chains to be connected.

Moreover, the flange portion 30*b* of the flexible plate body 30 may be positioned toward the upstream side and secured to the riverbed, whereby the amount of foreign matter taken between the riverbed and the lower inflatable chamber can be advantageously reduced. In this case, it is desirable to anchor a tongued portion 30'*b* to the riverbed 4 by means of chains 31.

In the embodiment of FIG. 25, the flexible plate body 40 shown in FIG. 13 is secured to the riverbed 4 with anchor bolts 5, washers 27 and nuts 7 and inflated by the supply of the fluid.

In the embodiments of FIGS. 23–25 are used the flexible plate bodies, each having a plurality of inflatable chambers and manufactured by an integrant press molding, as the collapsible rubber dam, but a plurality of separate plate bodies may be merely placed one upon another as shown in FIG. 26.

In the embodiment of FIG. 26, a first flexible plate body 50 is secured to the riverbed 4 at its solid flange portion 50*b* with anchor bolts 5, nuts 7 and the like, while a second flexible plate body 50' is secured to the riverbed at its plated fit portion 50'*b* with anchor bolts 5, nuts 7 and the like in such a manner that the free end of the plated fit portion 50'*b* is located at a position toward the upstream side over the plated fit portion 50*b* so as to place an inflatable chamber 50'*a* upon an inflatable chamber 50*a*. When each inflatable chamber is inflated by the supply of the fluid, the inflatable chamber 50'*a* of the second body 50' is positioned just above the inflatable chamber 50*a* of the first body 50 or somewhat toward downstream side therefrom and the first inflatable chamber 50*a* is covered with the long flange portion 50'*b* of the second body 50', whereby a two-stage collapsible rubber dam can easily be obtained.

Moreover, it is desirable to stabilize the second flexible plate body 50' in the inflated state by forming holes (not shown) in the portion 50'*b* at proper positions to penetrate water into spaces $S_1$ and $S_2$ defined by the first and second bodies 50 and 50' and the riverbed 4. Considering the case of flowing water backward, it is favorable to anchor a tongued portion 50''*b* of the second body 50' to the riverbed 4 by means of chains 31.

As exemplified in FIG. 27, the multi-stage collapsible rubber dam may be formed by connecting at least two flexible plate bodies 50 with each other at adjoining opposite ends by means of bolts 5' and nuts 7.

As described above, the collapsible rubber dam having a desired height can easily be produced by placing a plurality of inflatable chambers one upon another, so that even if one of the inflatable chambers is deflated due to the damage, the function as the dam is sufficiently retained by the other inflatable chambers. Further, when using n numbers of inflatable chamber, the dam height of n+1 stages can be adjusted, so that the water level to be dammed can effectively be adjusted.

Furthermore, when the multi-stage collapsible rubber dam as described above is compared with the conventional single-chamber dam made from the rubbery sheet material at the same dam height, the time required for inflation or deflation of inflatable chamber can be considerably shortened in the multi-stage rubber dam, because there are established the following relationships:

$$V_0 > V_1 + V_2$$

$$P_0 > P_1 + P_2$$

wherein $V_0$ and $P_0$ represent a volume and an internal pressure of the conventional single-chamber dam, respectively, $V_1$ and $P_1$ represent a volume and an internal pressure of a first inflatable chamber in, for example, two-stage dam according to the invention, respectively, and $V_2$ and $P_2$ represent a volume and an internal pressure of a second inflatable chamber in the two-stage dam, respectively.

When using the flexible plate body having at least two inflatable chambers connected to each other as shown in FIGS. 23, 25 and 27, the securing operation to the riverbed is considerably simplified, so that on location workability is excellent.

Each of the flexible plate bodies as described above is secured at its one end portion to the riverbed in the upstream or downstream side, so that they can develop the desired damming effect during the ordinary use in forward flow. When they are located at a branch point between the main course and the sub course or near the mouth of the river, however, if backward flow is temporarily caused in flooded condition, there is a fear of causing the damage by application of an excessive force. In FIGS. 28–32*b* examples of the collapsible rubber dam capable of retaining a stable dam height against both forward and backward flows are shown.

In the embodiment of FIG. 28, the collapsible rubber dam is a flexible plate body 60 having a hollow split part or inflatable chamber 60*a* and two flange portions 60*b* and 60*c*, a modified embodiment of FIG. 9. As shown in FIG. 28, the flexible plate body 60 is secured to the riverbed 4 with anchor bolts 5, keep members 6 and nuts 7 in such a manner that the portion 60*b* is located at the upstream side and the plated fit portion 60*c* is located at the downstream side.

FIG. 29*a* shows an inflated state of the flexible plate body 60 by the supply of the fluid for use in forward flow. In this case, the amount of foreign matter such as stone, sand and the like taken between the riverbed and the dam is decreased. Further, a sheet-like part 60*d* extends from the inflatable chamber 60*a* to the portion 60*c* toward the downstream side, so that water flows over the dam along the sheet-like part 60*d* without falling down on the riverbed of the downstream side. As a result, scooping out of the riverbed is completely prevented.

When the collapsible rubber dam is designed from the flexible plate body 60 shown in FIG. 28, if the dam height of the river to be dammed, the positions of the plated fit portions 60*b* and 60*c* to be secured on the riverbed, and the like are previously determined, the total length L of the plated fit portion 60*c* and the sheet-like part 60*d* can be measured from the following equations based on FIGS. 28 and 29*a*. At first, the total length L has a relationship of $L \simeq l_2 + l_3$. On the other hand, a relationship of $l_4 + S + l_3 = l_1 + l_2$ is established in FIG. 28, while a relationship of $(2S/\pi)^2 + (l_2 + l_3)^2 = (l_1 - l_4)^2$ is established from Pythagoras theorem in FIG. 29*a*. If the values of $l_1$, $l_4$ and S are previously determined, the values of $l_2$ and $l_3$ can be measured from the above relationships.

The inflated rubber dam 60 shown in FIG. 29*a* changes into a state shown in FIG. 29*b* when backward flow exists in the flooded condition. In this case, the flange portion 60*c* is connected to the inflatable chamber 60*a* through the sheet-like part 60*d*, so that the rubber dam 60 itself is not thrust up toward the upstream side. As a result, excessive force is not applied to the secured portions of the rubber dam.

As shown in FIG. 30, a multi-stage collapsible rubber dam having a higher dam height can simply be manufactured by combining the flexible plate body 60 of FIG. 28 with the flexible plate body 20 as shown in FIG. 9.

In the embodiment of FIG. 31, the collapsible rubber dam is made from a flexible plate body 70 having a hollow split part or inflatable chamber 70*a*, flange portions 70*b* and 70*c*, and a tongued portion 70*d*, provided that the plated fit portion 70*c* is projected from a center position of the lower surface of the inflatable chamber 70*a* over the tongued portion 70*d* toward the downstream side. This flexible plate body 70 can simply be produced in the same manner as described in the manufacture of the flexible plate body 1 of FIG. 3. FIGS. 32*a* and 32*b* therefor show inflated states of the flexible plate body 70 of FIG. 31 secured to the riverbed 4 by the supply of the fluid, respectively, wherein FIG. 32*a* shows the inflated state in the forward flow and FIG. 32*b* shows the inflated state in the backward flow. In the embodiment of FIG. 32*a*, the sheet-like flange portion 70*c* protects damage of the riverbed due to the falling down of the overflow, so that there is no scooping out of the riverbed at the downstream side. Furthermore, in the embodiment of FIG. 32*b*, the tongued portion 70*d* projecting from the pointed end of the inflatable chamber 70*a* efficiently acts as an anti-reverse-flow board. Therefore, the flexible plate body 70 of FIG. 31 develops a remarkable effect as a tide embankment or the like for completely damming the backward flow.

The flexible plate bodies as shown in FIGS. 28 and 31 are formed by press molding a pair of portions to be secured to the riverbed at the upstream and downstream sides and an inflatable chamber extending therebetween together with each other, so that they are very easy in the securing to the riverbed and become flat in the deflated state without obstructing the water flow. On the other hand, even when the backward flow is caused in the flooded condition, excessive force is not applied to the secured portions of the flexible plate body because the portion at the downstream side is connected to the inflatable chamber, so that the backward flow can completely be dammed.

When the flexible plate body 20 as shown in FIG. 9 is extended between the riverbanks and secured to the riverbed as shown in FIG. 33 and riverbank and thereafter inflated by the supply of the fluid to form a collapsible rubber dam, there is caused a crumpling phenomenon at a portion a of the inflatable chamber near the intersect between the riverbed and the riverbank. This is illustrated in FIGS. 33 and 34. Such a phenomenon is unavoidable owing to such a design demand that the collapsible rubber dam must be in close contact to the riverbed and riverbank in the deflated state.

Now, when the crumpling phenomenon is caused in the inflated state of the flexible plate body, the dam height reduces at the crumpled portion a and as a result, the leakage of the dammed water from the upstream side to the downstream side takes place at such crumpled portion a, so that the damming effect may not satisfactorily be achieved. Further, when the crumpled portion a and its neighborhood are directly exposed to sunlight, cracks are apt to be formed resulting in the damage of the dam. In order to prevent the occurrence of crumpling phenomenon, it has been found that the inflatable chamber of the flexible plate body as previously mentioned is reinforced with a bias cut weave fabric as shown in FIG. 35.

In the embodiment of FIG. 35, the flexible plate body 80 comprises a hollow split part or inflatable chamber 80*a*, a flange portion 80*b* united with the inflatable chamber and extending along its lengthwise direction, and a bias cut weave fabric 3 embedded about the inflatable chamber as a reinforcement, which is a modified embodiment of FIG. 9. As shown in FIG. 36, the flange 80*c* can be formed in a wave or pleat manner.

The bias cut weave fabric 3 for reinforcing the inflatable chamber 80*a*, are obtained by cutting a plain weave fabric composed of synthetic fibers such as nylon, tetron and the like at a given bias angle, ones obtained by superimposing even number of tire cords, which are usually used as a reinforcement for tire, one upon another at a given bias angle, and the like.

The bias angle of the bias cut weave fabric 3 varies depending upon an ascent of the riverbank, but it is preferably not more than 54°44′ (angle of repose).

The flexible plate body 80 is secured to the riverbed 4 and riverbank 8 with bolts and nuts in the same manner as previously mentioned and then inflated by the supply of the fluid, whereby a collapsible rubber dam having no crumpled portion is formed owing to the contracting action of the bias cut weave fabric 3 as shown in FIG. 37.

In order to manufacture the collapsible rubber dam having no crumpled portion as described above, the bias angle of the bias cut weave fabric to be embedded is determined as follows. That is, the cause of crumpling phenomenon is due to the fact that the top length L of the dam is not equal to the total length $(l_1+l_2+\omega)$ of the dam secured to the riverbed and riverbank. Therefore, if the bias angle is determined so as to absorb the difference between the top length and the total length $(l_1+l_2+\omega)-L$, there is caused no crumpling phenomenon. In other words, the length to be contracted is determined from the ascent of the riverbank and the dam height, so that the bias angle may be selected so as to counterbalance the contracted length. For instance, when the ascent $\alpha$ of the riverbank is $\tan\alpha=\frac{1}{2}$, the bias angle is about 45°.

The contraction degree of the flexible plate body 80 reinforced with the bias cut weave fabric 3 will be described with reference to the following experiment.

As a collapsible rubber dam, there was provided a flexible plate body 80 of a fifth model scale with a length of about 3 m and a height of about 30 cm wherein a bias cut weave fabric 3 composed of nylon fibers is embedded around an inflatable chamber 80*a* at a bias angle ($\theta$) of 45° with respect to horizontal direction. The four measuring points were previously determined in substantially the central part of the rubber dam as shown in FIG. 38 and then the change of the distance between the measuring points against an internal pressure of the inflatable chamber was measured to obtain a result as shown in the following Table 1.

TABLE 1

| Internal pressure (kg/cm$^2$) | A (mm) | B (mm) | C, D (mm) | H (mm) | $\theta$ |
|---|---|---|---|---|---|
| 0 | 281 | 279 | 178 | — | 45 |
| 0.027 | 277 | 276 | 182 | 260 | 46 |
| 0.076 | 269 | 268.5 | 193 | 280 | 48 |
| 0.160 | 266 | 264 | 196 | 280 | 49 |
| 0.190 | 264.5 | 263.5 | 197 | 297 | 50 |

From the data of Table 1, it is apparent that the bias angle approaches to the angle of repose (54°44′) with the increase of the internal pressure, whereby the distances A and B in the lengthwise direction of the dam are contracted and the distances C and D in the height direction are extended to increase the dam height (H). This shows that the bias cut weave fabric serves to prevent the crumpling.

When the flexible plate body 80 of FIG. 35 is inflated by the supply of the fluid, the tongued portion 80*c* forms pleats due to the contracting action of the bias cut weave fabric 3 as shown in FIG. 36. These pleats develop a sufficient effect for cutting the dammed water and as a result, the vibration of the dam itself is suppressed and the noise control and durability are improved.

According to the invention, the crumpling phenomenon, which has never been avoided in the prior art, can completely be prevented by reinforcing at least the periphery of the inflatable chamber with the bias cut weave fabric as mentioned above. As a result, the leakage of water from upstream side to downstream side and the formation of cracks, which are caused at the crumpled portion, are prevented while maintaining a proper dam height. Also, the weathering resistance is improved.

Even when the inflatable chamber is reinforced with the bias cut weave fabric, if the ascent of the riverbank is too large, the crumpling phenomenon may be caused. In this case, both end portions of the rubber dam each including the crumpled portion a near the riverbank may locally be covered with flexible sheets 81, respectively, as shown in FIGS. 39 and 40. That is, the edge portion of the flexible sheet 81 locating at upstream side is secured to the riverbed 4 and riverbank 8 together with the plated fit portion of the flexible plate body 80 in the same manner as described on FIG. 5 (see FIG. 40), while the other edge portion of the flexible sheet 81 freely hangs down toward downstream side so as to cover the crumpled portion a of the flexible plate body 80 (see FIG. 39). In this case, it is desirable to contact only the free edge of the flexible sheet 81 with the surface of the downstream flow.

That is, the flexible sheet 81 completely covers the crumpled portion a in the inflation of the rubber dam and can closely adhere to the riverbed and riverbank in a flat shape without crumpling in the deflation of the rubber dam.

The invention will now be described with reference to the flexible plate body as shown in FIGS. 41*a*–41*c*, wherein the flexible plate body 90 has a main inflatable chamber 90*a* and an auxiliary inflatable chamber 91 in order to discharge the fluid supplied to the inflatable chambers more smoothly.

As shown in FIGS. 41*a*–41*c*, the auxiliary inflatable chamber 91 has a diameter smaller than that of the main inflatable chamber 90*a* and is formed in the thick portion of the main inflatable chamber 90*a* along its lengthwise direction.

In order to inflate a collapsible rubber dam by supplying a fluid to the flexible plate body 90, there is used, for example, a piping system for supplying and discharging the fluid as shown in FIG. 42, wherein numeral 93 is a pipe for supplying the fluid to the main inflatable chamber 90*a*, numeral 94 is a pipe for supplying the fluid to the auxiliary inflatable chamber 91, symbols $V_1$, $V_2$, $V_3$ and $V_4$ are valves, symbol E is an ejector and symbol P is a pump or an air compressor.

When the flexible plate body 90 is inflated in such a state as shown in FIG. 41*a*, the valve $V_1$ is opened and the valves $V_2$, $V_3$ and $V_4$ are closed, and thereafter the fluid such as air, water or the like is pumped into the main inflatable chamber 90*a* through the pipe 93 by the actuation of the pump P. In this case, it is not necessary to inflate the auxiliary inflatable chamber 91 by the supply of the fluid.

When the inflated rubber dam is deflated, the fluid filled in the main inflatable chamber 90*a* may be discharged into the atmosphere only by opening the valve $V_2$. In the piping system of FIG. 42, however, it is preferable to actuate the pump P in such a state that the valves $V_1$, $V_2$ and $V_3$ are opened and the valve $V_4$ is closed. In the latter case, the fluid filling the main inflatable chamber 90*a* is forcedly discharged from the valve $V_3$ by the action of the ejector E, while the auxiliary inflatable chamber 91 is inflated to protrude inside the main inflatable chamber 90*a*. Thus, the inflated rubber dam begins to promptly deflate from that portion of the main inflatable chamber 90*a* unbalances a relation between the internal pressure of the main inflatable chamber 90*a* and the water pressure applied externally.

In the conventional rubber dam made from the rubbery sheet material, when the inlet port for supplying the fluid is only disposed in one end of the dam as shown in FIG. 42, if the deflation starts from the vicinity of the center portion of the dam in the lengthwise direction, the opposed inner walls of the inflatable chamber closely adhere to each other at the deflated portion, so that it is impossible to discharge the fluid filled in the space between the deflated portion and the other end of the dam having no inlet port. As a result, abnormal deflation of the dam takes place. In order to prevent the occurrence of abnormal deflation, it has hitherto been practiced that the plurality of inlet ports are opened at the side facing the riverbed and airtightly connected to a pipe embedded in the riverbed. Therefore, the piping work is very complicated in the manufacture of the conventional rubber dam.

On the contrary, even when the rubber dam according to the invention begins to deflate at any position in the lengthwise direction, the auxiliary inflatable chamber 91 protrudes inside the main inflatable chamber 90*a* to form a continuous clearance part 92 as shown in FIG. 41*b*, so that the opposed inner walls of the main inflatable chamber 90*a* do not adhere to each other due to the water pressure. Further, the continuous clearance part 92 extends along the auxiliary inflatable chamber 91 near the inlet port therefor in the lengthwise direction, so that the fluid staying in the main inflatable chamber 90*a* is completely discharged through the continuous clearance part 92 from the inlet port to the atmosphere. In general, the fluid in the main inflatable chamber 90*a* moves toward the downstream side under an influence of water flow in the deflated state, so that it is desirable to locate the auxiliary inflatable chamber 91 at the downstream side to form the continuous clearance part 92 in the downstream side. Thus, the rubber dam itself is completely deflated while leaving the auxiliary inflatable chamber 92 as it is.

Since the diameter of the auxiliary inflatable chamber 91 is considerably smaller than that of the main inflatable chamber 90*a*, the auxiliary inflatable chamber 91 does not obstruct the water flow even in the inflated state. Therefore, the fluid in the auxiliary inflatable chamber 91 may be discharged by opening the valve $V_4$ to the atmosphere in a long time. Alternatively, the fluid filled in the auxiliary inflatable chamber may forcedly be discharged by closing the valves $V_1$ and $V_3$ and opening the valves $V_2$ and $V_4$ through the actuation of the pump P. Moreover, the fluid filled in the auxiliary inflatable chamber 91 can promptly be discharged by placing an air-permeable canvas in the auxiliary inflatable chamber 91. Thus, the rubber dam is completely deflated as shown in FIG. 41*c*.

According to the invention, the inflation and deflation of the rubber dam can simply and completely be performed only by disposing the inlet port in the end of the dam without using a plurality of inlet port connected to the pipe embedded the riverbed, so that the workability and operability are excellent.

Further, the flexible plate body 90 with thicker gauge and higher rigidity can easily be manufactured by the integrant press molding as previously mentioned, so that the continuous clearance part 92 can surely be formed by the auxiliary inflatable chamber 91.

Moreover, the auxiliary inflatable chamber 91 can be formed in the thick portion of the main inflatable chamber 90*a* as shown in FIG. 41*c*, but may separately be provided on the inner wall surface of the main inflatable chamber 90*a*. In the latter case, the auxiliary inflatable chamber 91 may be separately adhered at its half periphery to the inner wall of the main inflatable chamber 90*a* by means of an adhesive. If the rigidity of the main inflatable chamber 90*a* is sufficiently high, the auxiliary inflatable chamber 91 may be adhered at one point to the inner wall of the main inflatable chamber 90*a* by means of an adhesive or may be placed inside the main inflatable chamber 90*a* without using the adhesive. Further, the plurality of the auxiliary inflatable chambers 91 may be connected to each other.

In the embodiment of FIGS. 43*a* and 43*b*, an auxiliary inflatable chamber 101 of a flexible plate body 100 is filled with a fluidizable material 102 capable of solidifying at room temperature instead of the fluid. The fluidizable material 102, may be temperature-dependent substances such as asphalt, thermoplastic resins, Minasu heavy oil, paraffin and the like; and chemical-change substances such as liquid rubber, cement, urethane resins, epoxy resins and the like. Preferably, the fluidizable material 102 is filled in the auxiliary inflatable chamber 101 by pumping from the one end of the chamber 101 and then solidified at room temperature.

The inflation and deflation of the flexible plate body 100 may be performed by using the piping system as shown in FIG. 42 except that the pipe 94 is omitted. When the inflated rubber dam 100 as shown in FIG. 43*a* is deflated in such a state as shown in FIG. 43*b*, continuous clearance parts 103 are formed inside the main inflatable chamber 100*a* along the lengthwise direction thereof because the auxiliary inflatable chamber 101 containing the solidified material 102 therein protrudes inside the main inflatable chamber 100*a*. As a result, the opposed inner walls of the main inflatable chamber 100*a* do not adhere to each other even when the water pressure is applied to the main inflatable chamber 100*a* from an external location. Thus, the flexible plate body 100 is completely deflated by discharging the fluid in the main inflatable chamber 100*a* through the continuous clearance parts 103 from the inlet port to the atmosphere.

According to the invention, at least one groove extending toward the lengthwise direction may be formed in the inner wall of the hollow split part or inflatable chamber of the flexible plate body instead of the provision of the auxiliary inflatable chamber, examples of which are shown in FIGS. 44*a*, 44*b* and 45.

In the embodiment of FIGS. 44*a* and 44*b*, six grooves 111 are formed in the inner wall of an inflatable chamber 110*a* of a flexible plate body 110. In the manufacture of the flexible plate body 110, shape members for the groove 111 are inserted at given positions of an area defining the inflatable chamber 110*a* between two crude rubber sheets along the lengthwise direction thereof prior to the integrant press molding. In some occasions, it is necessary to keep a long flexible plate body in a wound state without pulling out the shape members. For this reason, it is preferable to use a fully packed rubber body, a rubber body embedding wires therein or the like as the shape member. When using such a shape member, it is necessary to cover the shape member with an antitack agent for preventing the adhesion to the crude rubber sheet. As a result, the pulling out of the shape member becomes easier after the integrant press molding.

The inflation and deflation of the flexible plate body 110 may be performed in the same manner as previously mentioned. When the inflated rubber dam 110 shown in FIG. 44*a* is deflated in such a state as shown in FIG. 44*b* from any position along the lengthwise direction thereof, even if the opposed inner walls of the inflated chamber 110*a* adhere to each other due to the water pressure applied from external, grooves 111 are existent in the inner wall of the inflatable chamber 110*a* toward the lengthwise direction, so that the fluid in the inflatable chamber 110*a* is completely discharged through the grooves 111 from the inlet port to the atmosphere. As a result, the rubber dam 110 is completely deflated as shown in FIG. 44*b* without causing abnormal deflation.

In the embodiment of FIG. 44, the groove 111 has a rectangular section, but the sectional shape of the groove may be made semi-circular. In the latter case, the shape member having a circular section can be used, so that the pulling out operation becomes easier. Besides, circular grooves 121 may be located at both ends of the deflated inflatable chamber 120*a* of the flexible plate body 120 as shown in FIG. 45. In this embodiment, the circular groove 121 can mitigate strain caused at the end of the inflatable chamber 120*a* during the inflation, so that the durability of the inflatable chamber 120*a* is further improved.

The number of grooves may be optionally selected and is not critical. Moreover, it is desirable to gather the grooves near the inlet port, but it is actually sufficient to extend the grooves over substantially a total length of the rubber dam without gathering.

In the embodiment of FIG. 46, a flexible plate body 130 having an opened split part 130*a*, wherein an upper sheet part has a width somewhat longer than that of a lower sheet part, is secured at its open end to the riverbed 4 with anchor bolts 5, keep member 6 and nuts 7 to meet the free ends of both upper and lower sheet parts with each other. As a result, a space portion 131 is always formed inside the split part or inflatable chamber 130*a* of the rubber dam 130 in the deflated state. Therefore, abnormal deflation of the rubber dam can be prevented even when the inlet port for supplying the fluid to the inflatable chamber is located only at one end of the rubber dam. Furthermore, the space portion 131 serves as a cushioning member against impacts of rolling stones and the like.

As shown in FIG. 46, a channel 133 having an arc shape in section is further disposed near a joint part 132 between the upper and lower sheet parts, so that the effect of discharging the fluid filled in the inflatable chamber is further ensured during the deflation of the rubber dam. Further, the channel 133 acts to disperse the strain in the vicinity of the joint part 132 during the inflation of the rubber dam, so that the durability of the rubber dam can be considerably improved. Moreover, the formation of the channel 133 may simply be carried out by arranging a nylon bar near the joint part between the upper and lower sheet parts in the manufacture of the flexible plate body 130. In this case, the nylon bar may easily be removed due to the presence of the open split part.

In FIGS. 47*a* and 47*b* are shown another securing embodiments of the flexible plate body 1 as shown in FIG. 3 to the riverbed, respectively.

In the embodiment of FIG. 47*a*, free ends 1*a* of the flexible plate body 1 are directed to upstream side and placed on the riverbed 4. Then, a U-shaped metallic coupling member 15 is interposed between the free ends 1*a* together with sealing materials (not shown) along the lengthwise direction of the flexible plate body 1 so as to form an inflatable chamber 9 developing an excellent airtightness in the inflation thereof. That is, the coupling member 15 takes a part of the inflatable chamber 9 of the collapsible rubber dam. Thereafter, anchor bolts 5 previously embedded in the riverbed 4 are passed through holes (not shown) formed at given positions of the flexible plate body 1 near its free ends 1*a* and of the coupling member 15 and fastened through the keep member 6 by nuts 7.

Thus, the flexible plate body 1 is airtightly secured to the riverbed 4, while a continuous clearance part 16 is formed by the coupling member 15 interposed between the free ends 1*a* in the lengthwise direction.

In the embodiment of FIG. 47*a*, the inflation and deflation of the rubber dam 1 is not obstructed during the supply or discharge of the fluid because the coupling member 15 also serves as a fitting member at a secured position of the flexible plate body 1 to the riverbed 4. Therefore, the coupling member 15 may be extended to a given position of the riverbank. Moreover, since the coupling member 15 is sufficient to take a part of the inflatable chamber, it may be located at any position of the inflatable chamber as apparent from the following embodiment, but it is particularly preferable to locate the coupling member 15 at a position secured to the riverbed 4 as shown in FIG. 47*a*. In the latter case, the securing operation of the flexible plate body 1 becomes more advantageous.

In the embodiment of FIG. 47*b*, free ends 1*a* of the flexible plate body 1 are directed to downstream side, while the tongued portion 12 of the body 1 is secured to the riverbed 4 at upstream side with anchor bolts 5, keep member 6 and nuts 7 in the same manner as described above. In this case, the U-shaped metallic coupling member 15 is interposed between the free ends 1*a* and airtightly fastened by bolts 5', keep member 6 and nuts 7 thereto.

In this embodiment, when the coupling member 15 is existent over the total length of the rubber dam 1, the inflation and deflation of the dam may not be performed smoothly. Therefore, it is desirable to interpose the coupling member 15 only between the free ends 1*a* corresponding to the riverbed 4. Moreover, the U-shaped metallic coupling member 15 is used as a rigid coupling member in the embodiment of FIG. 47*b*, but plastics, rigid rubber, rubbers embedding therein various reinforcements, and the like can be used. In any case, the coupling member is sufficient to be approximately a rigid shape to the water pressure in the deflated state.

According to the invention, the flexible plate body with a thicker gauge can easily be manufactured by the integrant press molding as compared with the sheet material usually used, so that the durability and weathering resistance of the body are excellent in use as a collapsible rubber dam. Particularly, the rubber dam is required to have significant safety against breakdown in view of the function of damming water flow of rivers or the like.

The invention will be described below with reference to examples of the flexible plate body having improved safety as a collapsible rubber dam.

In the embodiment of FIG. 48, a partition wall 141 is disposed in a hollow split part or inflatable chamber of a flexible plate body 140 to divide the inflatable chamber into two chamber parts 140*a* and 140*a'*. In this case, a partition wall 141 has a width substantially equal to a half peripheral length of the inflatable chamber. Moreover, a plurality of partition walls each having an optional width may be used so as to divide the inflatable chamber into desired chamber parts.

The flexible plate body 140 can easily be manufactured by the integrant press molding starting from proper number of crude rubber sheets and antitack members. The body 140 may be inflated as shown in FIG. 48 by using a piping system as shown in FIGS. 49 and 50.

As shown in FIG. 50, two flanged nipples 10, 10' are inserted in one end of the flexible plate body 140 to communicate with the inflatable chamber parts 140*a* and 140*a'* while interposing the partition wall 141 around each nipple up and down, and thereafter the end portion of the body with nipples is sandwiched between a pair of keep members 11' each having semi-circular curved portions and fastened by bolts and nuts. Then, the nipples 10, 10' are connected to pipes 142, 143 in the piping system shown in FIG. 49, respectively.

When the flexible plate body 140 is inflated as shown in FIG. 48 by using the piping system of FIG. 49, valves $V_1$ and $V_2$ are opened, while valves $V_3$ and $V_4$ are closed. Thereafter, the air compressor or pump P is actuated to supply a fluid such as air, water or the like to two inflatable chamber parts 140*a* and 140*a'* through the pipes 142 and 143.

In the embodiment of FIG. 48, the fluid is filled in each inflatable chamber part 140*a*, 140*a'* at substantially the same internal pressure, but the internal pressure in the inflatable chamber parts may be different. Moreover, only one of the inflatable chamber parts may be inflated.

In the rubber dam of FIG. 48, even if one (140*a*) of the inflatable chamber parts is broken by the accidental impact of driftwoods, rolling stones and the like, the rubber dam retains a dam height to a certain extend without complete deflation, because the airtightness of the other inflatable chamber part 140*a'* is still maintained. As a result, flood damage at downstream side can be prevented in the case of deflation of the dam. Moreover, a given dam height can be maintained by further supplying the fluid through the pipe 143 to the inflatable chamber part 140*a'* after the inflatable chamber part 140*a* is broken.

The deflation of the rubber dam 140 may be performed in the same manner as described in the piping system of FIG. 42.

In FIGS. 51–53 are shown the other modified embodiments of the flexible plate body 140 having the partition wall 141 therein as shown in FIG. 48. These embodiments have means for promptly and completely deflating the rubber dam as shown in FIGS. 41*a* and 44*a* even when the piping system for the supply and discharge of the fluid is located only at the end portion of the rubber dam as shown in FIG. 49.

In the embodiment of FIG. 51, two auxiliary inflatable chambers 145, 145 are formed in the inner walls of the inflatable chamber parts 140*a*, 140*a'* constituting the main inflatable chamber of the flexible plate body 140 and extend along the lengthwise direction thereof. These auxiliary inflatable chambers 145, 145 have a diameter smaller than that of the main inflatable chamber, so that they may be separately provided on the main inflatable chamber different from the embodiment of FIG. 51.

In the embodiment of FIG. 52, the auxiliary inflatable chamber 145 is formed in substantially a central portion of the partition wall 141 along the lengthwise direction thereof different from the case of FIG. 51.

When deflating the flexible plate body 140 as shown in FIGS. 51 and 52, the auxiliary inflatable chamber 145 protrudes inside the main inflatable chamber in the inflated state to form a continuous clearance part extending up to the inlet port along the lengthwise direction, so that the fluid in the main inflatable chamber is completely discharged through the clearance part to the atmosphere without adhering the opposed inner walls of the main inflatable chamber with each other. In this way, the flexible plate body 140 as shown in FIGS. 51 and 52 can completely be deflated without causing abnormal deflation.

In the embodiment of FIG. 53, a plurality of grooves 146 are formed in the inner walls of the inflatable chamber parts 140*a*, 140*a'* along the lengthwise direction thereof instead of the auxiliary inflatable chamber 145. In this case, the complete deflation can be expected because the grooves 146 perform the function similar to the auxiliary inflatable chamber 145. Moreover, the grooves 146 may be formed in both sides of the partition wall 141 instead of the inner wall of the main inflatable chamber.

In the above embodiments, the partition wall 141 may be made from a resilient material such as rigid plastics or the like. In this case, the rubber dam can more easily be deflated.

In FIGS. 54*a* and 54*b* an embodiment of a flexible plate body 150 is shown wherein a great number of protrusions 151 and depressions 152 are provided on at least a part of an outer surface of a closed split part or inflatable chamber 150*a* along the lengthwise direction of the flexible plate body 150.

The manufacture of the surface-roughened flexible plate body 150 may be carried out by integrant press molding as previously mentioned except that a rough canvas is interposed between the upper or lower surface of the crude rubber sheet and the surface plate at predetermined position. After the press molding, the flexible plate body 150 having protrusions 151 and depressions 152 at its outer surface is obtained by the removal of the rough canvas. As shown in FIG. 54*b*, it is preferable that the great number of protrusions 151 and depressions 152 are provided on at least a part of the outer surface of the inflatable chamber 150*a* including an area of maximum dam height in the inflated state.

When the protrusions 151 and depressions 152 are formed on the outer surface of the inflatable chamber 150*a*, tensile stress uniformly applied to the overall surface of the inflatable chamber having an even and smooth outer surface is dispersed in the projections and depressions and concentrates mainly in the depressions. Further, most of the depressions are not directly exposed to sunlight due to the presence of the protrusions. In general, the smooth outer surface of the inflatable chamber is apt to cause cracking at an area exposed to sunlight under an influence of tensile stress. According to the invention, the area exposed to sunlight is reduced by the formation of protrusions and depressions, while the tensile stress is apt to be concentrated in a non-exposed area or the depressions, so that the occurrence of cracks on the rubber surface due to exposure of sunlight can effectively be prevented and as a result, the durability and weathering resistance are considerably improved. Further, there is no risk of slipping by a worker walking on the rubber dam in the inflated state as shown in FIG. 54*b*.

In the embodiment of FIGS. 54*a* and 54*b*, the size of the protrusion 151 and depression 152 is as follows: that is, the width of the protrusion is not more than 10 mm, and the width and depth of the depression are not more than 10 mm, respectively. The width and depth of the protrusion and depression are preferably about 3 mm, respectively. In order to effectively prevent the occurrence of cracks, the depth of the depression is preferably somewhat longer than the width of the protrusion and depression.

Moreover, the protrusions and depressions may be provided on the outer surface of the inflatable chamber by a surface roughening process after the integrant press molding or a sheet material having a great number of protrusions and depressions may be separately attached to the flexible plate body.

According to the invention, the flexible plate body as a collapsible rubber dam is previously formed into a flat shape corresponding to the deflated state of the rubber dam by the integrant press molding, so that spot working such as folding of sheet material and the like is not necessary in the securing operation. Further, the flexible plate body with a thicker gauge can easily be manufactured as compared with the conventional rubber dam made from the rubbery sheet material, so that the damage of the rubber dam is hardly caused and the durability and weathering resistance are considerably improved. Moreover, special stress concentration is not caused at any portion of the flexible plate body in the deflated state and hence the occurrence of cracks is prevented effectively.

In the securing to the riverbed and riverbank, the flexible plate body according to the invention can directly and airtightly be secured to the riverbed and riverbank by means of anchor bolts and nuts. Hence, the securing operation is very easy and the securing efficiency is further improved.

Furthermore, when the split part of the flexible plate body is a hollow split part, the airtightness of the resulting body can sufficiently be checked in the manufacturing site, so that the securing operation is improved considerably.

What is claimed is:

1. A collapsible rubber dam comprising; a flexible plate body composed of a rubbery elastomeric material, flexible plate body provided in the uninflated state with at least one split portion at a predetermined position in a thickness direction and extending along a lengthwise direction thereof; said split portion terminating with a solid flange portion extending in the thickness direction; said solid flange portion eliminating any folds in said plate body thereby reducing stresses and cracking in the uninflated state; means for securing said plate body airtightly to a riverbed and a riverbank; said split portion in an inflated state defining an inflated chamber and receiving a supply of inflating fluid.

2. A collapsible rubber dam as claimed in claim 1, wherein said split part is a hollow split part.

3. A collapsible rubber dam as claimed in claim 1, wherein said inflatable chamber is reinforced with a bias cut weave fabric.

4. A collapsible rubber dam as claimed in claim 1, wherein said inflatable chamber is provided with an auxiliary inflatable chamber having a diameter smaller than that of said inflated chamber along the lengthwise direction thereof, said auxiliary inflatable chamber forming a continuous clearance portion to prevent contact between inner walls of the split portion when said dam is in a deflated state.

5. A collapsible rubber dam as claimed in claim 4, wherein said auxiliary inflatable chamber is filled with a fluidizable material capable of solidifying at room temperature.

6. A collapsible rubber dam as claimed in claim 1, wherein said inflated chamber is provided at its inner wall with at least one continuous groove along the lengthwise direction thereof.

7. A collapsible rubber dam as claimed in claim 1, at least a part of said inflated chamber is watertightly constructed with a rigid coupling member along the lengthwise direction thereof.

8. A collapsible rubber dam as claimed in claim 1, wherein said inflated chamber is provided with at least one partition wall united to the inner wall of said inflatable chamber along the lengthwise direction thereof.

9. A collapsible rubber dam as claimed in claim 1, wherein at least a part of the outer surface of said inflated chamber is roughened along the lengthwise direction thereof.

10. A multi-stage collapsible rubber dam comprising; at least two flexible plate bodies superimposed one upon another; each of said bodies being composed of rubbery elastomeric material and provided in the uninflated state with at least one split portion at a predetermined position in a thickness direction and extending along a lengthwise direction thereof; said split portion of each of said bodies, terminating with a solid flange portion extending in the thickness direction; said solid flange portion eliminating any folds in said plate body thereby reducing stresses and cracking in the uninflated state; means for securing at least one of said plate bodies to a riverbed; and means to inflate said split portions.

* * * * *